US011944188B2

(12) United States Patent
Bärtschi

(10) Patent No.: US 11,944,188 B2
(45) Date of Patent: Apr. 2, 2024

(54) ORAL HYGIENE PRODUCT, IN PARTICULAR TOOTHBRUSH

(71) Applicant: TRISA HOLDING AG, Triengen Luzern (CH)

(72) Inventor: Armin Bärtschi, Winznau (CH)

(73) Assignee: TRISA HOLDING AG, Triengen (CH)

( * ) Notice: Subject to any disclaimer, the term of this patent is extended or adjusted under 35 U.S.C. 154(b) by 0 days.

(21) Appl. No.: 17/266,290

(22) PCT Filed: Jul. 31, 2019

(86) PCT No.: PCT/EP2019/070702
§ 371 (c)(1),
(2) Date: Feb. 5, 2021

(87) PCT Pub. No.: WO2020/030511
PCT Pub. Date: Feb. 13, 2020

(65) Prior Publication Data

US 2021/0196034 A1 Jul. 1, 2021

(30) Foreign Application Priority Data

Aug. 6, 2018 (EP) ..... 18187463

(51) Int. Cl.
*A46B 5/02* (2006.01)

(52) U.S. Cl.
CPC ..... *A46B 5/026* (2013.01); *A46B 2200/1066* (2013.01)

(58) Field of Classification Search
CPC .... A46B 5/026; A46B 5/02; A46B 2200/1066
USPC ..... 15/167.1, 143.1; 16/430
See application file for complete search history.

(56) References Cited

U.S. PATENT DOCUMENTS 5,054,154 A * 10/1991 Schiffer ..... A46B 5/0062 D4/138
5,339,482 A * 8/1994 Desimone ..... B25G 1/102 16/DIG. 19
2002/0138931 A1* 10/2002 Davies ..... A46B 5/02 15/167.1
2006/0213018 A1* 9/2006 Gross ..... A46B 5/02 15/143.1
2010/0058550 A1* 3/2010 Ballmaier ..... B29C 45/0046 15/167.1

(Continued)

FOREIGN PATENT DOCUMENTS

EP 1 532 891 A1 5/2005
EP 1 927 454 A1 6/2008
WO 2014/092672 A1 6/2014

OTHER PUBLICATIONS

Feb. 12, 2019 Extended Search Report issued in European Patent Application No. 18187463.7.

(Continued)

*Primary Examiner* — Tom Rodgers
*Assistant Examiner* — Jacob Adam Montgomery
(74) *Attorney, Agent, or Firm* — Oliff PLC

(57) ABSTRACT

An oral hygiene product, in particular a toothbrush, comprises at least one application unit and at least one handle unit, the at least one handle unit being formed partly from a soft component and partly from a hard component, wherein the soft component extends at least over a substantial part of a main extent of the at least one handle unit.

18 Claims, 5 Drawing Sheets

(56) References Cited

U.S. PATENT DOCUMENTS

Figure 1:
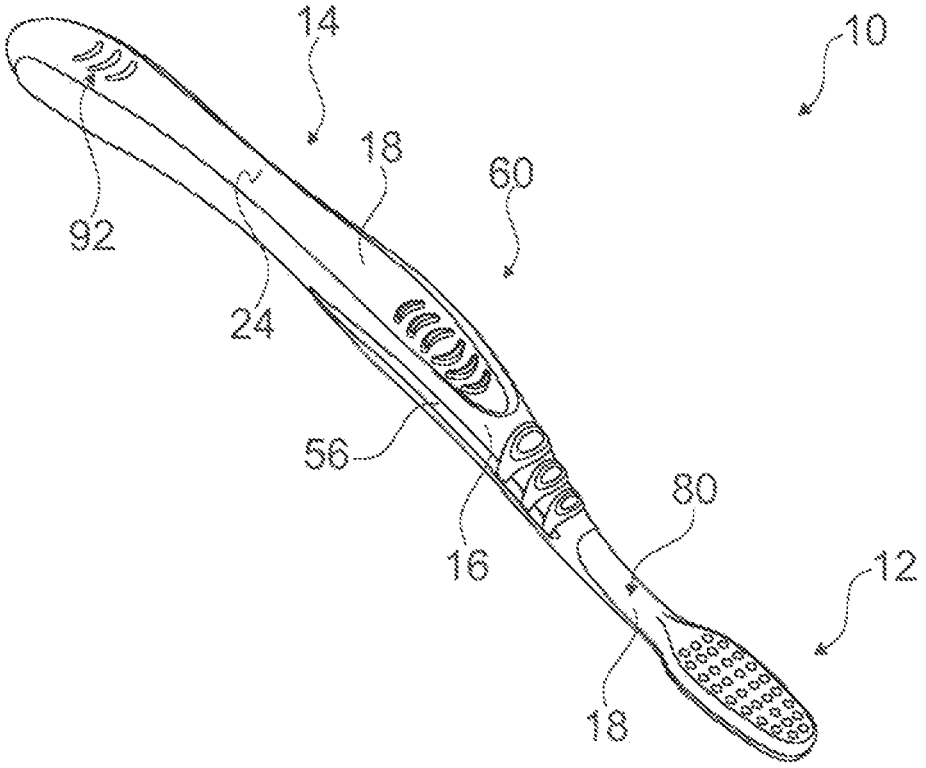

| | | | | |
|---|---|---|---|---|
| 2010/0101037 | A1 | 4/2010 | Gross et al. | |
| 2011/0146015 | A1* | 6/2011 | Moskovich | B29C 45/14344 15/167.1 |
| 2012/0036662 | A1* | 2/2012 | Kling | A46B 5/026 15/144.1 |
| 2015/0313350 | A1* | 11/2015 | Hohlbein | A61C 17/225 15/167.1 |
| 2016/0073769 | A1* | 3/2016 | Xi | A46B 15/0087 15/143.1 |
| 2017/0071330 | A1* | 3/2017 | Gross | B29C 37/0025 |

OTHER PUBLICATIONS

Oct. 21, 2019 International Search Report issued in International Patent Application No. PCT/EP2019/070702.

Feb. 9, 2021 International Preliminary Report on Patentability issued in International Patent Application No. PCT/EP2019/070702.

* cited by examiner

ORAL HYGIENE PRODUCT, IN PARTICULAR TOOTHBRUSH

PRIOR ART

The invention relates to an oral hygiene product, in particular a toothbrush.

An oral hygiene product comprising at least one application unit and at least one handle unit, the at least one handle unit being formed partly from a soft component and partly from a hard component, has already been proposed.

The object of the invention is in particular to provide a device of the generic type that has improved properties with regard to comfort and ergonomics. The object is achieved according to the invention by the features of patent claim 1, while advantageous configurations and developments of the invention can be taken from the subclaims.

Advantages of the Invention

The invention is based on an oral hygiene product, in particular a toothbrush, comprising at least one application unit and at least one handle unit, the at least one handle unit being formed partly from a soft component and partly from a hard component.

It is proposed that the soft component extends at least over a substantial part of a main extent of the at least one handle unit. Preferably, the soft component extends at least over 30%, preferably at least over 50%, with preference at least over 70% and with particular preference at least over 90%, of a main extent of the at least one handle unit. With preference, the soft component extends at least over 30%, preferably at least over 50%, with preference at least over 70% and with particular preference at least over 90%, of a main extent of the oral hygiene product. Preferably, the oral hygiene product consists of an application unit with bristles and the handle unit, the application unit having in particular a neck part, which connects the application unit to the handle unit. All of the sub-elements may consist of at least one hard component and/or one or more soft components. Preferably, the soft component forms a soft element that is in particular continuous, while the hard component forms a hard element that is in particular continuous.

The configuration according to the invention of the oral hygiene product allows advantageous properties to be provided with respect to ergonomics of the oral hygiene product. In particular, advantageous grippability of the handle unit can be achieved over an entire gripping region. In particular, an advantageous hold, in particular with a nonslip effect, can be reliably provided, irrespective of a gripping position. Preferably, the soft element also forms at least part of the application unit. In particular, it is conceivable that the soft element forms at least one cleaning element, for instance a massaging element, a tongue cleaner, such as in particular on the rear side of the oral hygiene product, or the like. Preferably, the soft element forms all of the elements made of the soft component of the handle unit and/or the application unit, at least apart from the cleaning element and/or bristles or the like. The soft component preferably forms at least one material bond with the hard component.

An "oral hygiene product" is to be understood as meaning in particular a toothbrush and/or an interdental cleaner and/or a flossing implement and/or a tongue cleaner and/or a toothpick. Advantageously, the oral hygiene product is formed as a toothbrush, in particular a manual toothbrush, preferably a child's toothbrush, advantageously a purely manual toothbrush. In particular, the oral hygiene product is different from an electric toothbrush. The oral hygiene product may in this case be a disposable toothbrush, a reusable toothbrush or else a replaceable-head toothbrush. The oral hygiene product has in particular a longitudinal axis, which is advantageously arranged at least substantially parallel to a main direction of extent of the oral hygiene product. With preference, the longitudinal axis runs at least in certain portions within the oral hygiene product and in particular through its center of gravity. In particular, the longitudinal axis of the oral hygiene product is a central axis of the oral hygiene product and/or a central axis of the handle unit. A "central axis" of an object is in this case to be understood as meaning in particular an imaginary axis which runs within the object parallel to a main direction of extent of the object and intersects the object at most at two points. "At least substantially parallel" is to be understood here as meaning in particular an alignment of a direction relative to a reference direction, in particular in one plane, the direction having a deviation with respect to the reference direction that is in particular less than 8°, advantageously less than 5° and particularly advantageously less than 2°. A "main direction of extent" of an object is in this case to be understood as meaning in particular a direction which runs parallel to a longest edge of a smallest imaginary cuboid that just still completely encloses the object. A "main extent" of an object is to be understood in this connection as meaning in particular an extent of a longest edge of a smallest imaginary cuboid that just still completely encloses the object.

In particular, the oral hygiene product has a length, in particular parallel to the longitudinal axis of the oral hygiene product, of at least 120 mm, advantageously of at least 140 mm and particularly advantageously of at least 165 mm and/or of at most 210 mm, advantageously of at most 190 mm and particularly advantageously of at most 185 mm, while it goes without saying that other, in particular smaller or greater, lengths are also conceivable. In particular, the oral hygiene product has a maximum width, in particular parallel to a width axis of the oral hygiene product, advantageously perpendicular to the longitudinal axis and/or parallel to a main plane of extent of the oral hygiene product and/or the handle unit, of at least 8 mm, advantageously of at least 10 mm and particularly advantageously of at least 12 mm and/or of at most 22 mm, advantageously of at most 20 mm and particularly advantageously of at most 17 mm. In particular, the oral hygiene product has a height, in particular measured parallel to a height axis of the oral hygiene product, advantageously measured perpendicularly to the longitudinal axis of the oral hygiene product and/or perpendicularly to the main plane of extent of the oral hygiene product, of at least 10 mm, advantageously of at least 12 mm and particularly advantageously of at least 15 mm and/or of at most 30 mm, advantageously of at most 25 mm and particularly advantageously of at most 19 mm. The term "height" relates here in particular to a state of the oral hygiene product in which it has been put down for example on a surface such as a tabletop, a wash basin, an upper side of a piece of furniture or the like, in particular in such a way that the longitudinal axis is arranged parallel to the surface. A "main plane of extent" of an object is to be understood as meaning in particular a plane which runs parallel to a largest side face of a smallest imaginary cuboid that just still completely encloses the object, and runs through the center point of the cuboid.

Advantageously, the application unit has at least one cleaning region, which is intended for a teeth cleaning application, in particular in an oral cavity of the user. Preferably, the cleaning region comprises at least one cleaning unit, in particular at least one brush head, advantageously a toothbrush head, with preference with multiple bristles and/or tufts of bristles and/or injection-molded cleaning elements and/or soft-elastic cleaning elements. The cleaning unit may however also be formed for example as an interdental brush and/or as a single tuft (for example a single large tuft of bristles) and/or as a bow spanned by dental floss, in particular as a flossing implement, or the like. Furthermore, the application unit advantageously has at least the neck element, which with preference is connected to the cleaning region, in particular directly and/or in one piece. "In one piece" is to be understood as meaning in particular at least integrally bonded, for example by a welding process, an adhesive-bonding process, a molding-on process and/or some other process that appears to be appropriate to a person skilled in the art, and/or advantageously formed in one piece, such as for example by being produced from the same mold and/or by being produced in a single-component or multi-component injection-molding process and advantageously from a single blank. "Intended" is to be understood as meaning in particular specifically designed and/or equipped. That an object is intended for a specific function is to be understood as meaning in particular that the object fulfills and/or performs this specific function in at least one application state and/or operating state.

The oral hygiene product has in particular a front side and a rear side, which are in particular facing away from one another. Preferably, the cleaning region is arranged on the front side of the oral hygiene product. The front side is in particular a side of the oral hygiene product that is visible in a viewing direction perpendicular to the longitudinal axis of the oral hygiene product and perpendicular to the width axis of the oral hygiene product. Referred to as the front side of the oral hygiene product is in particular that side of the brush on which the thumb is placed. The front side is normally also that side to which the bristle area is directed. The rear side advantageously corresponds to a side of the oral hygiene product that is visible in a viewing direction opposite to that. Referred to as the rear side of the oral hygiene product is the side of the toothbrush opposite from the bristle area. Referred to as the left side of the oral hygiene product is in particular a side that lies on the left when one looks at the front side of the oral hygiene product perpendicularly.

Preferably, the handle unit has at least one handle element, which is advantageously intended for holding with a hand, in particular with a child's hand. With preference, the handle element is of a tapered form. This advantageously allows a secure hold and optimizes the ergonomics. With particular preference, the handle element is of an elongate form, a longitudinal axis of the handle element advantageously corresponding to the longitudinal axis of the oral hygiene product. The handle element is advantageously formed partly from a soft component and partly from a hard component. In particular, the handle element advantageously comprises at least one thumb gripping region and/or at least one hand gripping region. Advantageously, the thumb gripping region is arranged on the front side of the oral hygiene product and in particular on a front side of the handle element. It is conceivable that the thumb gripping region and/or the hand gripping region have at least one element and/or a surface structuring of a soft component.

Advantageously, the gripping region has at least one hand gripping element, which with preference is formed from a soft component and/or is arranged on the rear side of the oral hygiene product. Preferably, a main direction of extent of the hand gripping element is arranged at least substantially parallel to the longitudinal axis of the oral hygiene product.

Advantageously, the hand gripping element has at least one surface structure element, particularly advantageously a plurality of surface structure elements, which are formed at least substantially identically or at least geometrically similarly to the surface structure elements described above of the thumb gripping element. Preferably, the surface structure elements of the hand gripping element are arranged respectively in groups one behind the other along the longitudinal axis of the oral hygiene product, in particular at least in pairs.

Within the scope of this disclosure, almost any hard components and soft components come into consideration, which a person skilled in the art will combine and/or select in an expediently suitable manner. Corning into consideration as a hard component are for example styrene polymers such as styrene acrylonitrile (SAN), polystyrene (PS), acrylonitrile butadiene styrene (ABS), styrene methylmethacrylates (SMMA), styrene butadiene (SB) or the like. Furthermore, a hard component may comprise polyolefins such as polypropylene (PP), polyethylene (PE) or the like, in particular also in the form of high-density polyethylene (HDPE) or low-density polyethylene (LDPE). Also coming into consideration are polyesters such as for example polyethylene terephthalate (PET), in particular in the form of acid-modified polyethylene terephthalate (PETA), glycol-modified polyethylene terephthalate (PETG), polybutylene terephthalate (PBT), acid-modified polycyclohexylenedimethylene terephthalate (PCT-A), glycol-modified polycyclohexylenedimethylene terephthalate (PCT-G) or the like. Furthermore, use of cellulose derivatives such as for example cellulose acetate (CA), cellulose acetobutyrate (CAB), cellulose propionate (CP), cellulose acetate phthalate (CAP), cellulose butyrate (CB) or the like is conceivable. Furthermore, a hard component may comprise for example polyamides (PA) such as PA 6.6, PA 6.10 or PA 6.12 or the like, polymethylmethacrylate (PMMA), polycarbonate (PC), polyoxymethylene (POM), polyvinyl chloride (PVC), polyurethane (PUR), polyamide (PA) or others of the like. In particular polyethylene (PE) and/or polyurethane (PU) can be used as a hard component and/or as a soft component. In particular, a hard component has a modulus of elasticity of at least 1000 $N/mm^2$ and advantageously of at least 1300 $N/mm^2$ and/or of at most 2400 $N/mm^2$ and advantageously of at most 1800 $N/mm^2$. Polypropylene (PP) is used with preference as the hard component.

Advantageously, hard components are used for stable and/or structure-bearing elements, in particular in the handle element and/or in a carrier element of the application unit and/or of the fastening unit or the like.

Preferably, the oral hygiene product or at least a main body of the oral hygiene product has a single hard component, which may be formed from one of the materials mentioned or else from a mixture of the same. However, combinations of different hard components are also conceivable, where these may for example be processed in a two- and/or multi-component injection-molding operation and/or be adhesively bonded and/or welded to one another, in particular ultrasonically welded. Alternatively or in addition, multiple hard components which do not enter into a material bond in a two- and/or multi-component injection-molding operation may be used. In particular, it is conceivable that in this case a form fit is produced between hard components, for example in the form of at least one undercut and/or at least one aperture and/or at least one at least partial encapsulation or the like. Here it is conceivable that for example a second hard component, which is in particular molded onto a first hard component, contracts and/or shrinks after an injection-molding operation and advantageously forms a shrink connection. Suitable combinations may be for example polypropylene-polyester, polypropylene-styrene acrylonitrile or other combinations.

Corning into consideration as soft components are for example thermoplastic styrene elastomers (TPE-S) such as for instance a styrene ethylene butylene styrene copolymer (SEBS), a styrene butadiene styrene copolymer (SBS) or the like. It is also conceivable to use thermoplastic polyurethane elastomers (TPE-U), thermoplastic polyamide elastomers (TPE-A), thermoplastic polyolefin elastomers (TPE-O), thermoplastic polyester elastomers (TPE-E) or the like. Furthermore, a soft component may comprise for example at least a silicone. Advantageously, a soft component has a Shore A hardness of at most 90, advantageously of at most 50 and particularly advantageously of at most 30. Preferably, at least one soft component forms at least one material bond with at least one hard component, in particular in at least a two- and/or multi-component injection-molding operation, advantageously by means of at least one overmolding and/or encapsulation.

It is advantageously conceivable that a hard component that is used and a soft component that is used are of different colors, so that surface structures, markings, motifs and the like can be realized by means of suitable creative design of the main body and the soft element.

Furthermore, it is proposed that the at least one application unit has a brush head, in particular toothbrush head, which is formed partly from a soft component and partly from a hard component. As a result, in particular, advantageous protection of a user during use can be achieved. In particular, protection of the oral cavity can be achieved. The application unit advantageously has at least one cleaning unit, in particular a toothbrush head, with bristles. The cleaning unit also advantageously has at least one bristle carrier, for example a brush head main body. At least some or all of the bristles are advantageously conventionally extruded bristles. Here, bristles may in particular comprise at least one hard component and/or at least one soft component. Preferably, the bristles are produced at least partially or completely from polyamide (PA) and/or from polyester (PBT), any other materials being conceivable. It is also conceivable that at least some of the bristles have a pointing and/or a variable cross section. Preferably, the bristles are formed from a single, in particular also mixed, material. Also conceivable however are bristles with multiple components, which may in particular be producible and/or produced by means of at least one coextrusion. The bristles may for example be producible and/or produced by means of extrusion, cutting to length and/or reworking. By contrast with injection-molded bristles or rubber-elastic massaging and cleaning elements, which are produced by means of injection molding, conventional bristles are extruded, cut, worked and inserted on the toothbrush handle by means of adapted methods, such as for example by means of the anchor punching method, the AFT method and/or the IMT method.

In particular, cylindrical or pointed bristles come into consideration, while any other cross sections such as for example polygonal, triangular, rectangular, square, elliptical, star-shaped, trapezoidal, parallelogram-shaped, rhombic or any other cross sections are conceivable. In particular, different bristles may be used in one tuft of bristles, but also different tufts of bristles may be used, in particular in each case with a specific type of bristles. Here, bristles and/or tufts of bristles may be arranged regularly but also irregularly. In particular, bristles and/or tufts of bristles arranged in groups and/or adjacently may differ, in particular alternately, with regard to at least one feature, such as for example a length, a diameter, a material, a color, a material hardness, a geometry, a pointed configuration and the like. Preferably, the bristles have a diameter, in particular perpendicular to the longitudinal axis thereof, of at least 0.075 mm and/or of at most 0.25 mm. Advantageously, the bristles have a cross-sectional area, in particular perpendicular to the longitudinal axis thereof, of at least 0.002 $mm^2$ and/or of at most 0.2 $mm^2$. In the case of bristles that are used in the cosmetics sector, for example bristles of an additional application element, thinner bristles and/or bristles with a smaller cross section may also be used, in particular bristles with a diameter, in particular perpendicular to the longitudinal axis thereof, of at least 0.02 mm and/or of at most 0.025 mm and/or with a cross-sectional area, in particular perpendicular to the longitudinal axis thereof, of at least 0.001 $mm^2$ and/or of at most 0.15 $mm^2$. In the case of pointed bristles, polyester (PBT) is particularly suitable as a material, while pointing can be produced mechanically and/or chemically. Other materials are similarly conceivable however. Preferably, the bristles are straight in the longitudinal direction, but corrugated and/or twisted and/or helical and/or rotated bristles are also conceivable, and in particular combinations of different bristles. Furthermore, bristles with a smooth surface are conceivable, as are bristles with a textured surface.

Furthermore, the bristles are processed, in particular fastened to the bristle carrier, in particular as a tuft of bristles, preferably by means of at least one anchor punching method, an anchor-free tufting method (AFT), an in-mold tufting method (IMT), a PTt method or the like. Preferably, the bristle carrier has a plurality of bristle receptacles, in particular holes for tufts of bristles, which are in particular drilled and/or molded in an injection-molding operation. In the case of anchor punching, it is for example conceivable that first a main body, in particular of a hard component, preferably of the brush head, is produced by means of an injection-molding operation, where blind holes for tufts of bristles are advantageously molded during the injection-molding operation. It goes without saying however that subsequent drilling of blind holes is also conceivable. Preferably, bristles or tufts of bristles are subsequently folded and fastened by means of at least one anchor in a blind hole in each case, in particular by being punched in. Similarly, loop punching is conceivable.

Alternatively, as mentioned, anchorless methods, where bristles or tufts of bristles are advantageously not folded, are also conceivable. In comparison with anchor punching, bristles or tufts of bristles are in this case approximately half the length. For example, here it is conceivable that the tufts of bristles are first individually separated, fused and/or their bristle ends are in particular subsequently encapsulated by injection molding for fastening them. This may advantageously involve tufts of bristles being brought together. Possible here is production by means of the in-mold tufting method (IMT), where advantageously a main body, for example of the brush head and/or of the handle unit and/or of the fastening unit, is formed during the encapsulation of the bristle ends. It is similarly conceivable that, in particular in the course of an integrated anchorless production process, bristles are first encapsulated by injection molding with plates or the like and these plates are subsequently in turn encapsulated, for example in order to form the brush head and/or the handle unit.

It is also conceivable that the application unit is made up of a main body and a bristle plate, which is occupied by bristles and/or alternative cleaning elements. For this purpose, first bristle plates are produced by means of injection molding with through-holes, through which bristles are subsequently led. Preferably, the bristles are subsequently connected on a rear side, in particular fused, preferably to one another and/or to the corresponding bristle plate. In this way, bristle plates provided with bristles can then be welded and/or adhesively bonded to a main body, in particular a brush head, preferably by means of ultrasonic welding. The anchor-free tufting method (from G. B. Boucherie nv), which makes it possible in particular for tufts of bristles to be brought together, may be mentioned in this connection as a known production method. Referred to as the underside of the bristle plate is in particular a side that is placed into a recess of the main body and faces in the direction of the underside of the oral hygiene product. Correspondingly, the upper side of the bristle plate faces in the direction of the upper side of the oral hygiene product.

Corning into consideration as a further method for providing bristles in an anchorless manner is that of producing, in particular injection molding, a brush head with through-holes for bristles. Bristles can be subsequently led through the through-holes and fused on a rear side, in particular to one another and/or to the brush head. This is preferably followed by an overmolding, in particular with at least one soft component, of the fused regions and/or of the brush head. Corning into consideration here for example is an AMR method (from G. B. Boucherie nv), which makes it possible in particular for tufts of bristles to be brought together, or an AMR+ method, which makes it possible in particular for bristles to be brought together.

It is also conceivable first to produce a brush head with blind holes, for example by means of injection molding and/or by means of drilling the blind holes. Bristles are in this case brought together into tufts and fused and/or otherwise connected at one end. The brush head is subsequently warmed, in particular to a glass transition temperature of its material. Then, tufts of bristles may be advantageously introduced into the blind holes and anchored on the brush head by means of pressing into place. In particular, this involves the warmed blind holes being deformed, so that the tufts of bristles are anchored in them. A known PTt method (from G. B. Boucherie nv) is suitable here for example.

As an alternative or in addition to punched and/or bonded bristles, molded-on bristles are also conceivable. These may be produced in particular during a multi-component injection-molding operation together with the application unit, the handle unit and/or the fastening unit, or be retrospectively molded onto a main body of the application unit.

A further possible method for providing the brush head with bristles is that of twisting in. This involves for example filament being fed from a roll, in particular multiple filament strands being wound up on a roll. For loading the machine, multiple rolls are in each case pretensioned, since each filament in the brush corresponds to a filament strand. The filaments are spread out in the correct width, in order that they have the width in which they are inserted into the brush. The filaments are drawn forward such that they subsequently protrude for the next step, i.e. that a wire can be passed over them. A wire is subsequently fed to the machine from a roll, i.e. is unwound, and introduced into the process. The wire is cut to a length which is greater than the unwound length of the twisted-in brush; the final cutting to length takes place after the twisting-in. The wire is bent into a U, in order that the open side can subsequently be pushed over the filaments in order to thread the bristles in. The wire is held against the base of the U. After that, the open wire end is clamped, in order that the filaments are held between the pieces of wire. The filaments are cut to a length that is greater than the final length in the brush, in order that the brush can be correctly cut subsequently, when the filaments have been twisted in. The wire is rotated, so that the filaments are clamped between the wire, and are consequently fixed. Once the filaments are fixed in the wire, they are cut to the correct length and profiled. Once the brush part has been completed, the excess wire is cut off.

It is preferably the case that materials of injection-molded bristles do not form a material bond with other soft components and/or hard components of the oral hygiene product during an injection-molding process, in particular a two- and/or multi-component injection-molding process. With preference, injection-molded bristles are rather connected to soft components and/or hard components by means of a form fit, for example by means of at least an undercut and/or at least one aperture and/or by means of at least one at least partial encapsulation, in particular a contraction connection and/or a shrink connection being conceivable. However, a connection by means of at least one material bond is also conceivable.

For all of the possible injection-molding processes mentioned, in principle a single-, two- and/or multi-component injection-molding operation is conceivable. Materials used, in particular of different soft components and/or hard components, may, as mentioned, in this case be connected and/or have been connected in an integral and/or a form-fitting manner. It is also conceivable for articulated connections to be formed by means of suitable injection-molding steps. In principle, hot-runner processes, cold-runner processes and/or co-injection processes come into consideration for example.

As an alternative or in addition to a brush head provided with bristles, the application unit may also have at least one tongue cleaner and/or at least one alternative cleaning and/or massaging element. These may be formed in each case from a soft component, from a hard component or from a combination of a soft component and a hard component and/or advantageously be producible and/or produced by means of injection molding.

Preferably, injection-molded bristles are at least partially and advantageously completely formed from a thermoplastic polyurethane elastomer (TPE-U). It is conceivable here to use a modified polyurethane elastomer (TPE-U), which may be modified in particular with respect to improved flow properties and/or rapid solidification, in particular rapid crystallization, advantageously already at higher temperatures. It goes without saying however that other materials are also conceivable, for example thermoplastic polyester elastomers (TPE-E), thermoplastic polyamide elastomers (TPE-A) or the like. Materials for injection-molded bristles advantageously have a Shore D hardness of at least 0 and particularly advantageously of at least 30 and/or of at most 100 and advantageously of at most 80. In particular, a Shore hardness of a material of injection-molded bristles is advantageously higher than a Shore hardness of other soft components used, for example for handle elements, massaging elements, further cleaning elements or the like.

In principle, use of water-soluble polymers is also conceivable, for example for hard components, soft components, injection-molded bristles or other elements of the oral hygiene product. Similarly, bioplastics, which may in particular be obtained from renewable raw materials, may be used. Corning into consideration here as raw materials are in particular maize, hemp, sugar, castor oil, palm oil, potatoes, wheat, sugarcane, rubber, wood, the castor-oil plant/castor plant and the like. Corresponding possible base materials could be for example cellulose, starch, lactic acid (PLA), glucose, chitin, chitosan and the like, from which in particular corresponding bioplastics can be synthesized.

It is also proposed that the soft component extends continuously over a large portion of a main extent of the oral hygiene product. Preferably, the soft component extends in particular uninterruptedly from the application unit over the handle unit. With preference, the soft component extends uninterruptedly at least over 30%, preferably at least over 50%, with preference at least over 70% and with particular preference at least over 90% of a main extent of the oral hygiene product. Preferably, in particular an end region of the handle unit of the oral hygiene product that is facing away from the application region is free from a soft component. As a result, in particular advantageously good ergonomics of the oral hygiene product can be provided. In particular, advantageous grippability of the handle unit can be achieved over its entire gripping region. In particular, an advantageous hold, in particular with a nonslip effect, can be reliably provided, irrespective of a gripping position. Preferably, the soft element forms all of the elements of a soft component of the fastening unit and/or the handle unit and/or the application unit, and/or of bristles and/or alternative cleaning elements or the like.

Furthermore, it is proposed that the soft component forms at least 30% of an outer surface of the at least one handle unit. Preferably, the soft component forms at least 40% and with particular preference at least 50% of an outer surface, in particular a projection of the outer surface, of the at least one handle unit. Preferably, a volume of the soft component of the oral hygiene product is at least 2 $cm^3$, preferably at least 4 $cm^3$, with preference a maximum of 7 $cm^3$ and with particular preference a maximum of 5 $cm^3$. Preferably, a volume of the hard component of the oral hygiene product is at least 7 $cm^3$, preferably at least 9 $cm^3$, with preference a maximum of 12 $cm^3$ and with particular preference a maximum of 10 $cm^3$. As a result, in particular advantageously good ergonomics of the oral hygiene product can be provided. In particular, advantageous grippability of the handle unit can be achieved over its entire gripping region.

It is also proposed that the at least one handle unit has at least one thumb gripping region with a gripping surface of the hard component and at least one structure element made of the soft component and rising above the gripping surface. Preferably, the structure element made of the soft component rises above at least the gripping surface of the hard component. The gripping surface of the hard component is in particular formed as at least substantially planar. In particular, the gripping surface of the hard component in the thumb gripping region forms a slight depression. The statement that the "structure element rises above the gripping surface" is to be understood in this connection as meaning in particular that the structure element protrudes beyond a directly adjoining gripping surface of the hard component. The structure element preferably forms in particular a local elevation with respect to the gripping surface of the hard component. "At least substantially planar" is to be understood in this connection as meaning in particular that an imaginary cuboid that just still completely encloses the area has a thickness of a maximum of 2 mm, preferably of a maximum of 1 mm and with particular preference of a maximum of 0.5 mm. As a result, in particular advantageously good ergonomics of the oral hygiene product can be provided.

It is also proposed that the at least one structure element is completely encompassed by the gripping surface. Preferably, the at least one structure element is completely encompassed by the gripping surface of the hard component. Preferably, the at least one structure element is completely surrounded by the gripping surface of the hard component in a plane of the gripping surface. The at least one structure element is in particular formed as detached. As a result, in particular advantageously good ergonomics of the oral hygiene product can be provided.

Advantageously, the thumb gripping region forms at least one structure element, in particular a plurality of, advantageously regularly arranged, structure elements, whereby in particular advantageous grippability can be achieved. A structure element is advantageously formed here as an elevation, in particular with a planar surface and/or with straight side walls. Alternatively, it is also conceivable that a structure element narrows, in particular conically, toward an upper side. Structure elements may be for example cylindrical, pyramidal, spherical segment-shaped, in particular semi-spherical, ovoid segment-shaped, or the like. Preferably, the structure elements are in particular sickle-shaped. A cross section (orientation in a plane between the upper side and the underside) of a structure element may be made up here of different geometrical figures, for example a semi-circle and an adjoining rectangle. Polygonal, in particular triangular, square, pentagonal or hexagonal, cross sections are similarly conceivable. Furthermore, any free-form figures are conceivable. Preferably, the structure elements of the thumb gripping region are formed as at least substantially identical to one another or at least geometrically similar.

In particular, the thumb gripping region has a length, in particular at least substantially parallel to the longitudinal axis of the oral hygiene product, of at least 3 mm, advantageously of at least 5 mm and particularly advantageously of at least 10 mm and/or of at most 35 mm, advantageously of at most 25 mm and particularly advantageously of at most 20 mm. In particular, the thumb gripping region has a width, in particular at least substantially perpendicular to the longitudinal axis of the oral hygiene product, of at least 3 mm, advantageously of at least 4 mm and particularly advantageously of at least 6 mm and/or of at most 25 mm, advantageously of at most 20 mm and particularly advantageously of at most 15 mm. A single structure element has in particular a height, in particular perpendicular to a surrounding surface of the thumb gripping region, of at least 0.2 mm, advantageously of at least 0.5 mm and particularly advantageously of at least 0.8 mm and/or of at most 3 mm, advantageously of at most 2 mm and particularly advantageously of at most 1.5 mm. Furthermore, a single structure element has in particular a width, in particular at least substantially perpendicular to the longitudinal axis of the oral hygiene product between the left side and right side, of at least 2 mm, advantageously of at least 3 mm and particularly advantageously of at least 5 mm and/or of at most 15 mm, advantageously of at most 12 mm and particularly advantageously of at most 9 mm. Moreover, a single structure element has in particular a length, in particular at least substantially parallel to the longitudinal axis of the oral hygiene product, of at least 0.3 mm, advantageously of at least 0.5 mm and particularly advantageously of at least 1 mm and/or of at most 5 mm, advantageously of at most 3 mm and particularly advantageously of at most 2 mm.

Preferably, a main direction of extent of a structure element is arranged here in each case at least substantially perpendicularly to a main direction of extent of the thumb gripping region. Furthermore, advantageously the main direction of extent of the thumb gripping region is arranged at least substantially parallel to the longitudinal axis of the oral hygiene product. Advantageously, at least two identically aligned structure elements are arranged one behind the other along the longitudinal axis of the oral hygiene product and/or transversely thereto. Preferably, at least one to five, in particular two to three, identically aligned structure elements are arranged in the longitudinal direction, with preference in each case in the longitudinal direction in relation to the longitudinal axis of the oral hygiene product with at least one further structure element, formed in particular mirror-symmetrically with respect to the longitudinal axis of the oral hygiene product, in pairs one behind the other, in particular at regular intervals, which with preference are less than a length of an individual structure element, where with preference a width and/or a length of structure elements arranged in the middle is greater than a width and/or a length of structure elements arranged at the edge of the thumb gripping region and with particular preference the width and/or length increases with each structure element toward the middle of the thumb gripping region. "At least substantially identical" objects are to be understood as meaning in particular objects which are designed in such a way that they can in each case fulfill a common function and, apart from production tolerances, preferably differ in their construction at most by individual elements that are unimportant for the common function, and advantageously objects which, apart from dimensions and particularly advantageously at least apart from production tolerances and/or within the limits of technical production possibilities, are formed identically or geometrically similarly, while identical objects are to be understood in particular as also meaning objects that are symmetrical to one another.

It is also proposed that the at least one handle unit has at least one delimiting wall made of the soft component and at least substantially delimiting the gripping surface of the thumb gripping region. Preferably, the delimiting wall delimits the gripping surface of the thumb gripping region in at least three directions. With preference, the delimiting wall reaches around the gripping surface of the thumb gripping region in a C-shaped form. A "delimiting wall" is to be understood in this connection as meaning in particular a web-shaped or offset-like elevation, which extends at least partially around the gripping surface of the thumb gripping region of the hard component. Preferably, the delimiting wall is connected in one piece with the further elements made of the soft component and is also produced from the latter. As a result, in particular an advantageous delimitation of the thumb gripping region can be provided.

It is also proposed that the at least one delimiting wall rises above the at least one structure element of the thumb gripping region. Preferably, a maximum distance of the delimiting wall from the main plane of extent of the oral hygiene product, measured perpendicularly to the main plane of extent, is greater than a maximum distance of the at least one structure element from the main plane of extent of the oral hygiene product, measured perpendicularly to the main plane of extent. Preferably, the delimiting wall is raised up with respect to the gripping surface of the thumb gripping region of the hard component to a greater extent than the at least one structure element is raised up with respect to the gripping surface of the thumb gripping region of the hard component. Furthermore, it is proposed that the at least one delimiting wall delimits the gripping surface of the thumb gripping region at least towards the application unit. Preferably, the gripping surface of the thumb gripping region is free from a delimitation by the delimiting wall in a direction facing away from the application unit. With preference, the gripping surface of the thumb gripping region is also delimited by the delimiting wall toward a left side and/or right side. As a result, in particular an advantageous hold of a thumb of a user in the thumb gripping region can be achieved. In particular, slipping of the thumb can be dependably avoided. In particular, it can be avoided that a thumb of the user slips over the thumb gripping region towards the application unit.

Furthermore, it is proposed that the at least one handle unit has at least one concavely curved essential gripping surface, which is at least largely formed from the soft component and has at least two islands of the hard component. Preferably, the at least one concavely curved essential gripping surface is arranged on a rear side of the handle unit that is facing away from the thumb gripping region. With preference, the at least one concavely curved essential gripping surface extends over a large portion of the main extent of the handle unit. The at least one concavely curved essential gripping surface serves in particular for resting an index finger, a middle finger, a ring finger, and/or a little finger of the user. In particular, the at least one concavely curved essential gripping surface forms a main gripping surface. Preferably, the islands of the hard component finish flush with the soft component. Preferably, the concavely curved essential gripping surface has multiple islands, in particular ten, of the hard component. The islands are in particular at least approximately circular. Preferably, the islands vary in diameter. With preference, the islands form in particular two parallel rows of in each case five islands along a longitudinal extent. A diameter of the islands increases in particular toward the two middle islands. As a result, in particular advantageously good ergonomics of the oral hygiene product can be provided. Furthermore, it can in particular be achieved that such a large area can be advantageously produced from the soft component. Furthermore, excessive yielding of the gripping surface during gripping can be avoided.

It is also proposed that the at least one concavely curved essential gripping surface has an index-finger gripping region made of the soft component, in which the structure elements made of the soft component and rising above the essential gripping surface are arranged. Advantageously, the index-finger gripping region forms at least one structure element, in particular a plurality of, advantageously regularly arranged, structure elements, whereby in particular advantageous grippability can be achieved. A structure element is advantageously formed here as an elevation, in particular with a planar surface and/or with straight side walls. Alternatively, it is also conceivable that a structure element narrows, in particular conically, toward an upper side. Structure elements may be for example cylindrical, pyramidal, spherical segment-shaped, in particular semi-spherical, ovoid segment-shaped, or the like. Preferably, the structure elements are in particular sickle-shaped. A cross section of a structure element (orientation in a plane between the upper side and the underside) may be made up here of different geometrical figures, for example a semi-circle and an adjoining rectangle. Polygonal, in particular triangular, square, pentagonal or hexagonal, cross sections are similarly conceivable. Furthermore, any freeform figures are conceivable. Preferably, the structure elements of the index-finger gripping region are formed as at least substantially identical to one another or at least geometrically similar.

In particular, the index-finger gripping region has a length, in particular at least substantially parallel to the longitudinal axis of the oral hygiene product, of at least 3 mm, advantageously of at least 5 mm and particularly advantageously of at least 10 mm and/or of at most 45 mm, advantageously of at most 40 mm and particularly advantageously of at most 35 mm. In particular, the index-finger gripping region has a width between the left side and right side, in particular at least substantially perpendicular to the longitudinal axis of the oral hygiene product, of at least 3 mm, advantageously of at least 4 mm and particularly advantageously of at least 6 mm and/or of at most 25 mm, advantageously of at most 20 mm and particularly advantageously of at most 15 mm. A single structure element has in particular a height, in particular perpendicular to a surrounding surface of the index-finger gripping region, of at least 0.3 mm, advantageously of at least 0.5 mm and particularly advantageously of at least 0.9 mm and/or of at most 2.5 mm, advantageously of at most 2 mm and particularly advantageously of at most 1.5 mm. Furthermore, a single structure element has in particular a width, in particular at least substantially perpendicular to the longitudinal axis of the oral hygiene product, of at least 2 mm, advantageously of at least 3 mm and particularly advantageously of at least 4 mm and/or of at most 18 mm, advantageously of at most 15 mm and particularly advantageously of at most 12 mm. Moreover, a single structure element has in particular a length, in particular at least substantially parallel to the longitudinal axis of the oral hygiene product, of at least 0.3 mm, advantageously of at least 0.5 mm and particularly advantageously of at least 1 mm and/or of at most 3.5 mm, advantageously of at most 2.5 mm and particularly advantageously of at most 2 mm.

Preferably, a main direction of extent of a structure element is arranged here in each case at least substantially perpendicularly to a main direction of extent of the index-finger gripping region. Furthermore, advantageously the main direction of extent of the index-finger gripping region is arranged at least substantially parallel to the longitudinal axis of the oral hygiene product. Advantageously, at least two structure elements are arranged one next to the other along the longitudinal axis of the oral hygiene product and/or transversely thereto. Advantageously, two to fourteen, in particular four to ten, structure elements are arranged one next to the other along the longitudinal axis of the oral hygiene product and/or transversely thereto. Preferably, at least one to seven, in particular two to five, structure elements are arranged in the longitudinal direction, with preference in each case transversely in relation to the longitudinal axis of the oral hygiene product with at least one further structure element, formed in particular mirror-symmetrically with respect to the longitudinal axis of the oral hygiene product, in pairs one next to the other, in particular at regular intervals, which with preference are less than a length of an individual structure element, where with preference a width and/or a length of structure elements arranged in the middle is greater than a width and/or a length of structure elements arranged at the edge and with particular preference the width and/or length increases with each structure element toward the middle of the index-finger gripping region.

It is also proposed that the at least one concavely curved essential gripping surface has a little-finger gripping region made of the soft component, in which the structure elements made of the soft component and rising above the essential gripping surface are arranged. Preferably, the little-finger gripping region is arranged on a side of the concavely curved essential gripping surface that is facing away from the index-finger region. With preference, the index-finger region is arranged on a side of the concavely curved essential gripping surface that is facing the application unit. With particular preference, the little-finger gripping region is arranged at a distance from the index-finger gripping region. Advantageously, the little-finger gripping region forms at least one structure element, in particular a plurality of, advantageously regularly arranged, structure elements, whereby in particular advantageous grippability can be achieved. A structure element is advantageously formed here as an elevation, in particular with a planar surface and/or with straight side walls. Alternatively, it is also conceivable that a structure element narrows, in particular conically, toward an upper side. Structure elements may be for example cylindrical, pyramidal, spherical segment-shaped, in particular semi-spherical, ovoid segment-shaped, or others of the like. Preferably, the structure elements are in particular sickle-shaped. A cross section of a structure element (orientation in a plane between the upper side and the underside) may be made up here of different geometrical figures, for example a semi-circle and an adjoining rectangle. Polygonal, in particular triangular, square, pentagonal or hexagonal, cross sections are similarly conceivable. Furthermore, any freeform figures are conceivable. Preferably, the structure elements of the little-finger gripping region are formed as at least substantially identical to one another or at least geometrically similar. As a result, in particular advantageously good ergonomics of the oral hygiene product can be provided.

The structure elements used in the various regions may in principle be similar or different in each case in terms of shape. Thus, a pattern that continues over the entire handle unit can be obtained.

It is also proposed that the at least two islands are arranged between the index-finger gripping region and the little-finger gripping region. As a result, an advantageously hard structure for gripping the oral hygiene product can be provided in particular in a region for a middle finger and a ring finger of the user. As a result, dependable, in particular stable, holding of the oral hygiene product can be ensured.

It is also proposed that the at least one handle unit has at least one lateral streak of the hard component, which is completely delimited by the soft component. Preferably, the at least one handle unit has a lateral streak respectively on both sides (left and right) of the thumb gripping region. The lateral streaks adjoin in particular the delimiting walls. Preferably, the at least one lateral streak extends along a separating line, in particular a production-related mold parting line, of the hard component of the oral hygiene product. Preferably, the streak has a curved shape. The lateral streak extends axially, in particular over the thumb gripping region as far as the neck element. As a result, in particular advantageous lateral stabilization can be provided in the injection-molding process. In particular, advantageous demoldability can be provided.

Furthermore, it is proposed that the at least one handle unit has at least one tongue made of the soft component, which extends over the at least one part of the lateral streak. Preferably, the at least one tongue made of the soft component extends into the lateral streak. The at least one tongue extends in particular perpendicularly to a main extent (from the front side to the rear side) of the streak over a large portion of the streak. With preference, the tongue extends transversely to a longitudinal axis of the oral hygiene product over at least 40%, preferably over at least 50% and with particular preference over at least 60% of the at least one lateral streak. Preferably, the at least one handle unit comprises at least six tongues made of the soft component, three respectively extending over one of the lateral streaks in each case. As a result, in particular advantageous protection of the lateral streak can be provided. In particular, impact can be avoided. Furthermore, in particular advantageous ergonomics of the oral hygiene product can be provided.

It is also proposed that the at least one handle unit has at an end facing away from the application unit on the rear side a planar resting area, which serves for the oral hygiene product to be put down in a defined way. The resting area serves in particular for the oral hygiene product to be put down flat on a surface such as a tabletop, a wash basin, an upper side of a piece of furniture or the like, in particular in such a way that the longitudinal axis is arranged substantially parallel to the surface. Preferably, the resting area serves in particular for putting the oral hygiene product down on a rear side. Preferably, the resting area adjoins in particular the little-finger gripping region. With preference, the resting area on a rear side of the oral hygiene product adjoins the concavely curved essential gripping surface. The resting area is arranged in particular in an end region of the oral hygiene product that is free from the soft component. In particular, the end region consists completely of the hard component. As a result, in particular dependable putting down of the oral hygiene product can be achieved. When the resting area is formed from the hard component, it can in particular be reliably achieved that the oral hygiene product can be put down without toppling over. Furthermore, it is proposed that the oral hygiene product has an imaginary resting plane, which extends free from points of intersection along at least two spaced-apart points of the oral hygiene product. Preferably, the imaginary resting plane extends through the resting area of the handle unit and at least one point or a resting line or resting area in the neck element of the oral hygiene product. When the oral hygiene product is put down on a rear side, the oral hygiene product rests in particular on the resting area of the handle unit and the at least one point in the neck element or the one resting line or resting area of the oral hygiene product. When the oral hygiene product is resting on the resting plane, the oral hygiene product is in particular unable to topple over. As a result, in particular dependable putting down of the oral hygiene product can be achieved. Furthermore, it is proposed that the planar resting area extends parallel to a main plane of extent of the oral hygiene product and defines the imaginary resting plane. With preference, the imaginary resting plane extends through the resting area of the handle unit and at least one point or a resting line or resting area in the neck element of the oral hygiene product.

Preferably, the resting area adjoins in particular the little-finger gripping region. With preference, the resting area on a rear side of the oral hygiene product adjoins the concavely curved essential gripping area. The resting area is arranged in particular in an end region of the oral hygiene product that is free from the soft component. In particular, the end region consists completely of the hard component. As a result, in particular dependable putting down of the oral hygiene product can be achieved. When the resting area is formed from the hard component, it can in particular be reliably achieved that the oral hygiene product can be put down without toppling over. Furthermore, it is proposed that the oral hygiene product has an imaginary resting plane, which extends free from points of intersection along at least two spaced-apart points of the oral hygiene product. Preferably, the imaginary resting plane extends through the resting area of the handle unit and at least one point or a resting line or resting area in the neck element of the oral hygiene product. When the oral hygiene product is put down on a rear side, the oral hygiene product rests in particular on the resting area of the handle unit and the at least one point in the neck element or the one resting line or resting area of the oral hygiene product. When the oral hygiene product is resting on the resting plane, the oral hygiene product is in particular unable to topple over. As a result, in particular dependable putting down of the oral hygiene product can be achieved. Furthermore, it is proposed that the planar resting area extends parallel to a main plane of extent of the oral hygiene product and defines the imaginary resting plane. With preference, the imaginary resting plane extends through the resting area of the handle unit and at least one point or a resting line or resting area in the neck element of the oral hygiene product.

It is also proposed that a maximum distance between a rear side of the handle unit and the resting plane, measured perpendicularly to the resting plane, is at least 3 mm. Preferably, the maximum distance between the rear side of the handle unit and the resting plane is from 3 mm to 18 mm and preferably from 7 mm to 13 mm. With preference, a maximum distance between the concavely curved essential gripping surface of the handle unit and the resting plane, measured perpendicularly to the resting plane, is at least 3 mm, preferably at least 5 mm and with particular preference at least 7 mm. Preferably, the handle unit has a strong curvature. A highest point of the handle unit in a put-down state corresponds at least approximately to a highest point of the bristles of the application unit in a put-down state. Preferably, a maximum distance between a highest point of the handle unit and the resting plane, measured perpendicularly to the resting plane, is at least 10 mm, preferably at least 13 mm and with particular preference at least 16 mm. With preference, a maximum distance between a highest point of the handle unit and the resting plane, measured perpendicularly to the resting plane, is a maximum of 30 mm, preferably at least 20 mm and with particular preference at least 18 mm. The put-down state is in particular a state in which the oral hygiene product has been put down onto a surface, which is in particular planar and/or smooth, preferably flat, in particular with the rear side of the oral hygiene product. Preferably, in the put-down state, the longitudinal axis of the oral hygiene product runs at least substantially parallel to the surface. As a result, in particular advantageously easy picking up of the oral hygiene product can be achieved. In particular, it is made possible for the handle unit to be at least partially gripped underneath. As a result, it can in particular be achieved that the oral hygiene product can be put down and picked up quickly and dependably.

Preferably, the soft element made of the soft component has a single injection point. With preference, the injection point is arranged on the rear side of the oral hygiene product.

Advantageously, the soft component finds its way from the handle unit into the brush head via at least one channel in the neck element.

In the transitional region of the handle unit and the neck element, the handle advantageously incorporates elements which may have a structure comprising two components. With preference, multiple similarly-shaped elements are arranged one behind the other. The elements advantageously differ in size. Particularly advantageously, the size decreases in the direction of the head.

The elements are preferably oval-shaped, but they may also have round or roundish shapes. The elements are preferably constructed such that a filled core of soft component is formed, delimited by a ring of hard component. Apart from this ring of hard component, there is advantageously formed a further ring of soft component, which may also further extend laterally of the geometry of the neck element and in particular go over into the described tongues that protrude into the streak. In particular, a core of the element on the surface of the end product has an extent in the longitudinal direction of the toothbrush of at least 1 mm, advantageously of at least 2 mm and of at most 6 mm, advantageously at most 4 mm and particularly advantageously at most 3 mm. The extent of the core of the element perpendicular to the longitudinal direction is in particular at least 2 mm, advantageously at least 3 mm and at most 9 mm, advantageously at most 7 mm and particularly advantageously at most 6 mm. The ring around the core of the element advantageously has a width of at least 0.5 mm and particularly advantageously of at least 1 mm.

Preferably, the elements at least partially contain structures which consist of soft component. The soft component is advantageously directed from the rear side of the main body to the front side through apertures in the main body. It can in this way form isolated islands on the front side of the main body.

Apart from the decorative element that is formed by means of the rings, the structure has the function in the injection-molding process of stabilizing the main body during the encapsulation, in order that it remains in the correct place.

The oral hygiene product according to the invention is not intended here to be restricted to the applications and embodiments described above. In particular, the oral hygiene product according to the invention may have a number of individual elements, components and units that differs from a number mentioned herein in order to perform a way of functioning described herein. Moreover, in the value ranges specified in this disclosure, values lying within the mentioned limits are also to be considered to be disclosed and arbitrarily usable.

It goes without saying that the configurational variants shown in this document are given by way of example. Within the scope of the invention, the individual refinements and elements of these configurational variants may be combined with other configurational variants without departing from the scope of this invention.

DRAWINGS

Further advantages will become evident from the following description of the drawings. The drawings illustrate an exemplary embodiment of the invention. The drawings, the description and the claims contain numerous features in combination. A person skilled in the art will also expediently consider the features individually and combine them to form appropriate further combinations.

Figure 2:
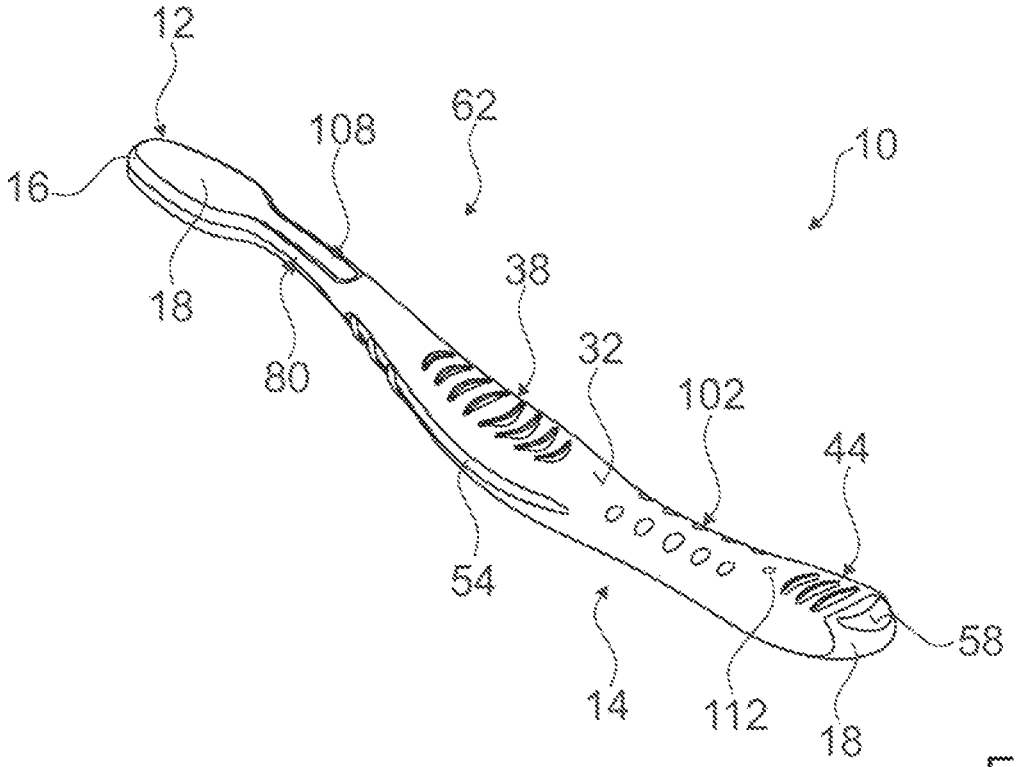
Figure 3:
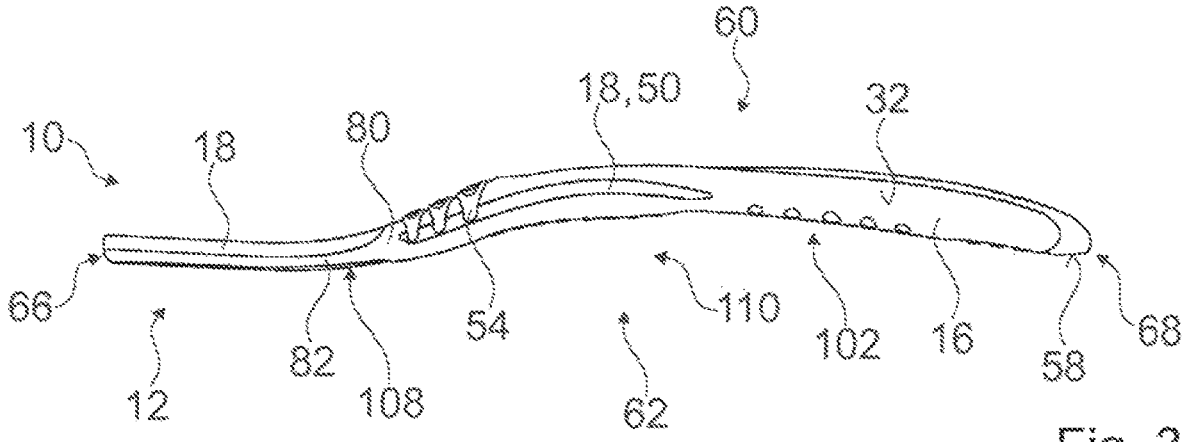
Figure 4:
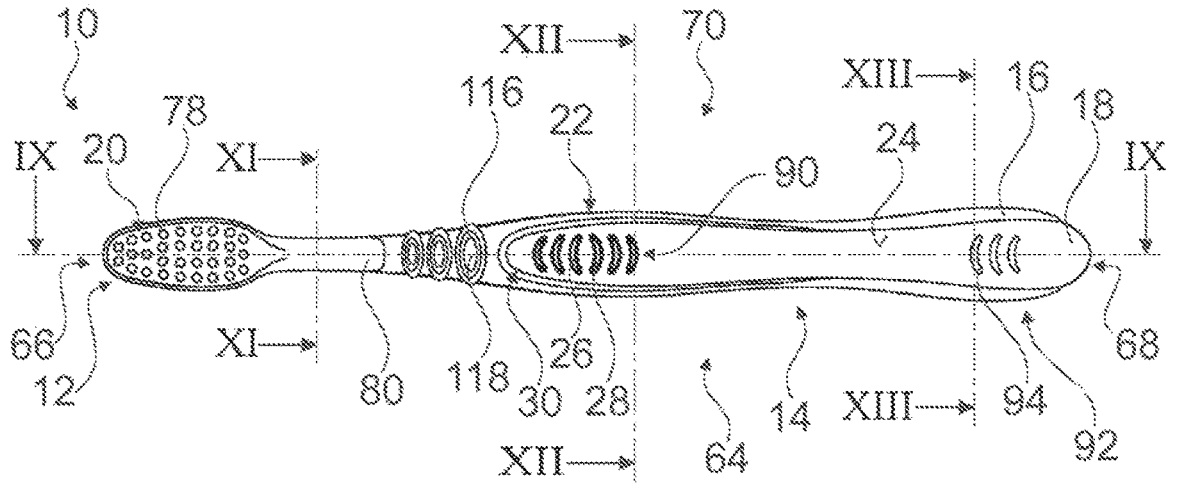
Figure 5:
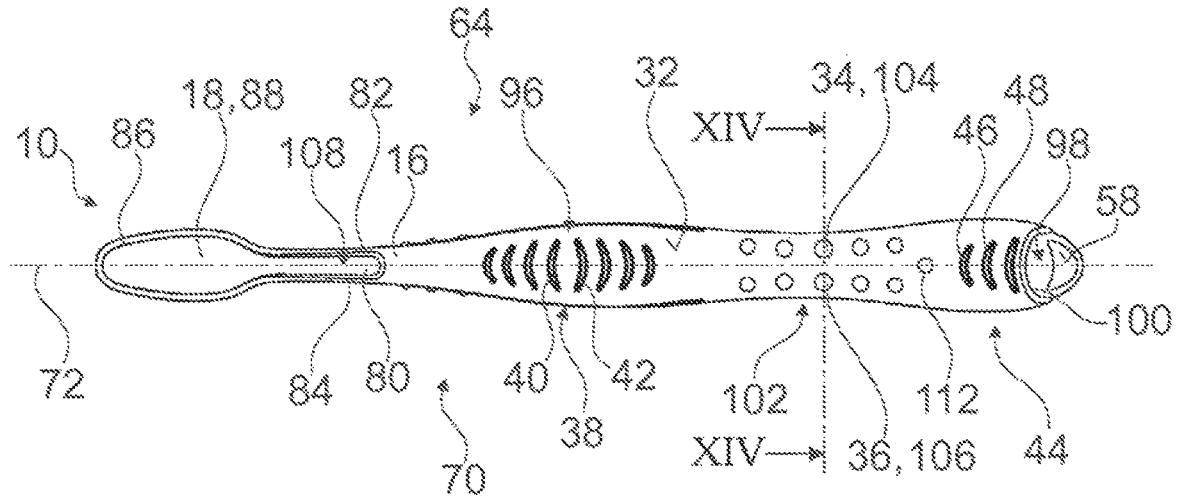
Figure 6:
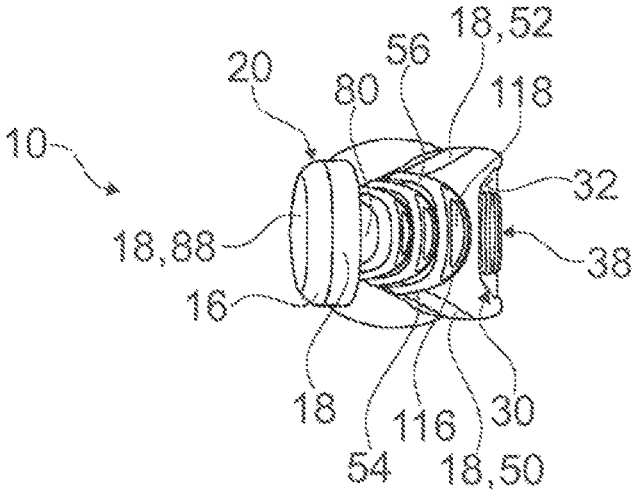
Figure 7:
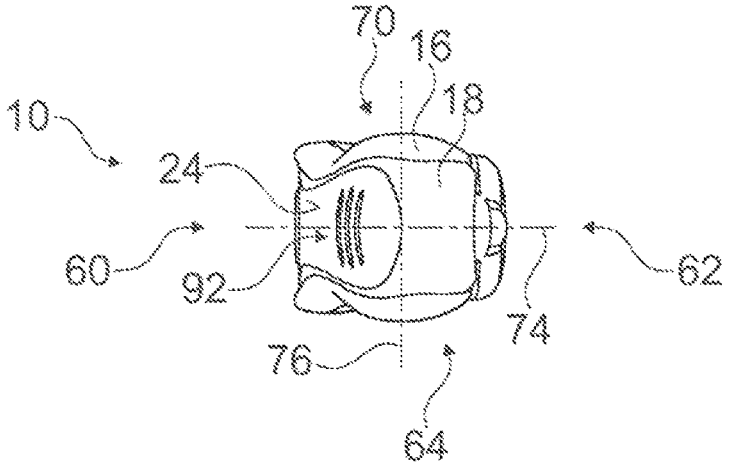
Figure 8:
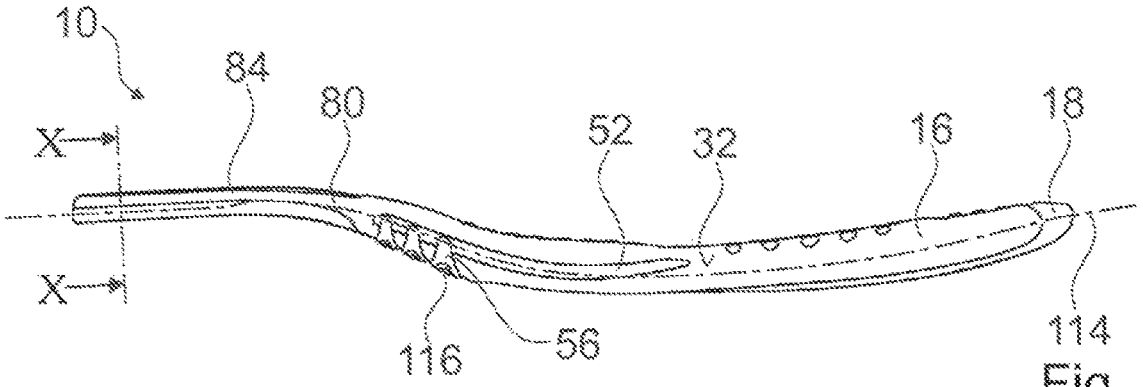
Figure 9:
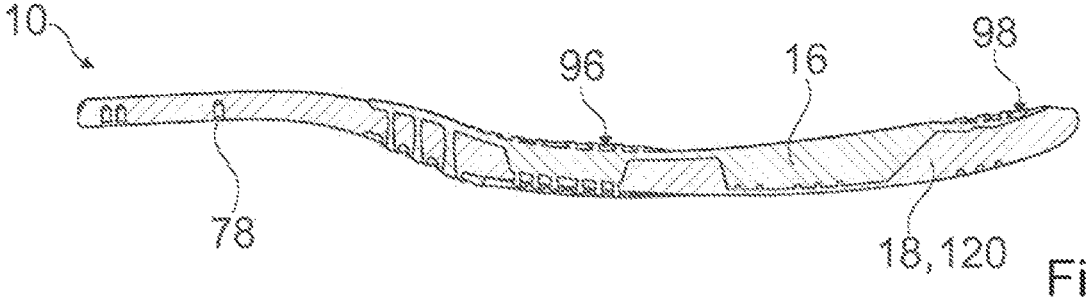
Figure 10:
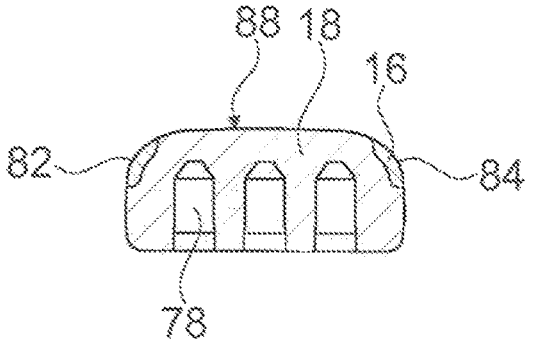
Figure 11:
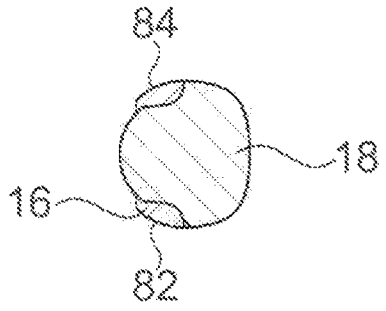
Figure 12:
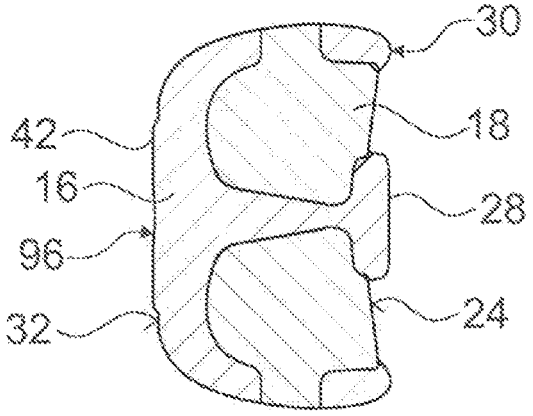
Figure 13:
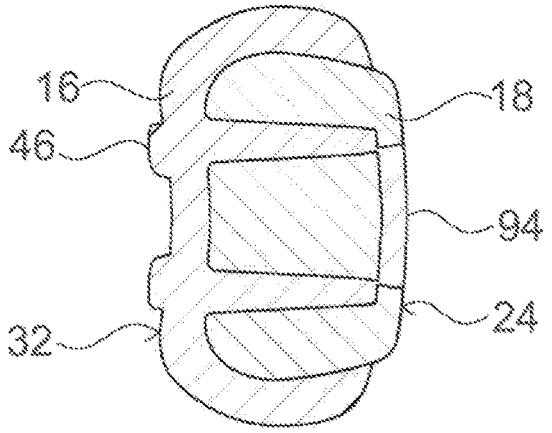
Figure 14:
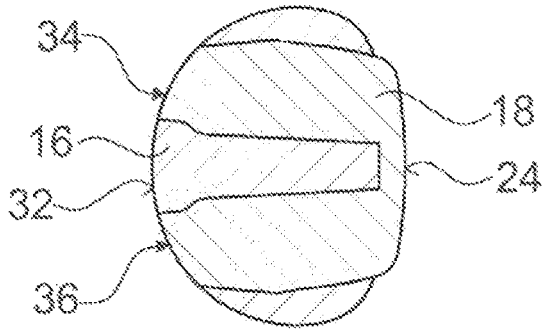
Figure 15:
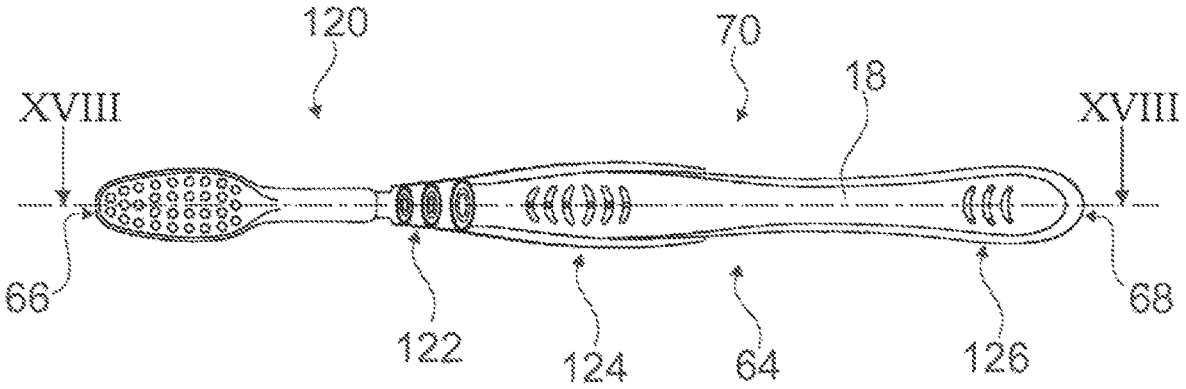
Figure 16:
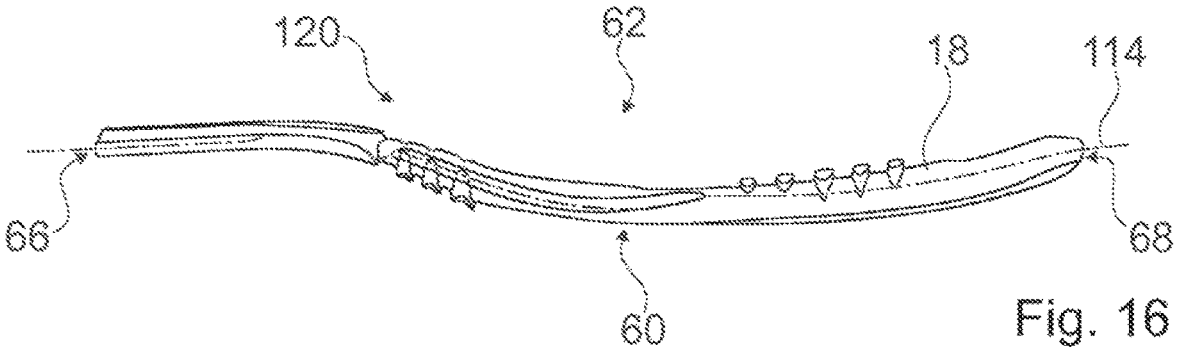
Figure 17:
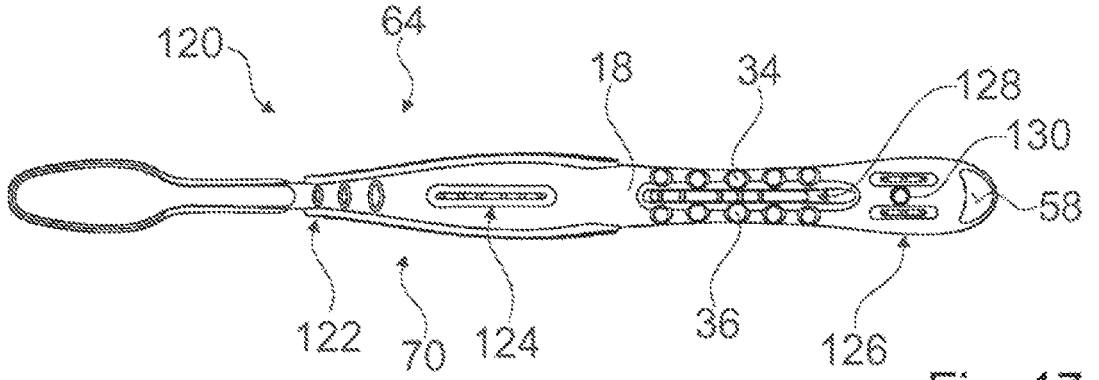
Figure 18:
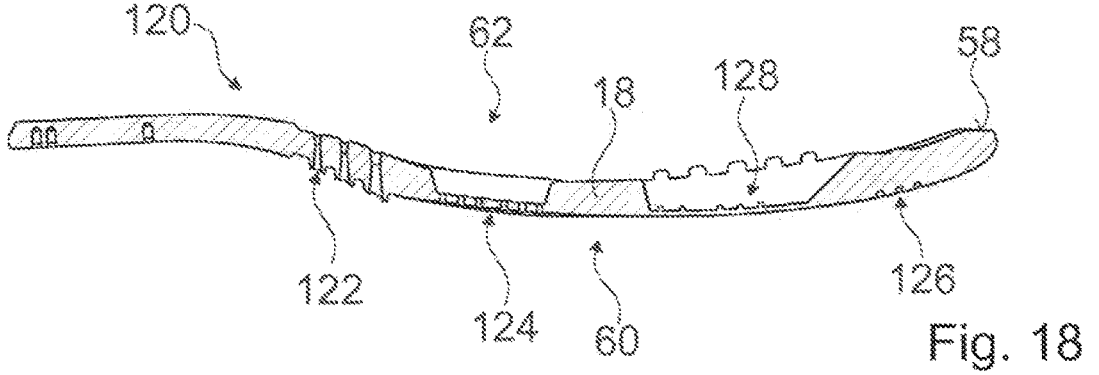

In the figures:

FIG. 1 shows a front side of an oral hygiene product in a schematic perspective representation, FIG. 2 shows a rear side of the oral hygiene product in a schematic perspective representation, FIG. 3 shows a side of the oral hygiene product in a schematic representation, FIG. 4 shows a front side of the oral hygiene product in a schematic representation, FIG. 5 shows a rear side of the oral hygiene product in a schematic representation, FIG. 6 shows an upper side of the oral hygiene product in a schematic representation, FIG. 7 shows an underside of the oral hygiene product in a schematic representation, FIG. 8 shows a further side of the oral hygiene product in a schematic representation with a depicted mold parting line, FIG. 9 shows a schematic sectional representation of the oral hygiene product along the sectional line IX-IX in FIG. 4, FIG. 10 shows a schematic sectional representation of the oral hygiene product along the sectional line X-X in FIG. 9, FIG. 11 shows a schematic sectional representation of the oral hygiene product along the sectional line XI-XI in FIG. 4, FIG. 12 shows a schematic sectional representation of the oral hygiene product along the sectional line XII-XII in FIG. 4, FIG. 13 shows a schematic sectional representation of the oral hygiene product along the sectional line XIII-XIII in FIG. 4, FIG. 14 shows a schematic sectional representation of the oral hygiene product along the sectional line XIV-XIV in FIG. 5, FIG. 15 shows a front side of a main body of the oral hygiene product in a schematic representation, FIG. 16 shows a side of the main body of the oral hygiene product in a schematic representation, FIG. 17 shows a rear side of the main body of the oral hygiene product in a schematic representation and FIG. 18 shows a schematic sectional representation of the main body of the oral hygiene product along the sectional line XVIII-XVIII in FIG. 15.

DESCRIPTION OF THE EXEMPLARY EMBODIMENT

FIG. 1 shows a front side 60 of an oral hygiene product 10 in a schematic perspective representation. The oral hygiene product 10 is in the present case formed as a toothbrush, in particular as a child's toothbrush. The oral hygiene product 10 may similarly be formed as a disposable toothbrush or else as a replaceable-head toothbrush. Moreover, the oral hygiene product 10 could be formed as a flossing implement, a single-tuft brush, an interdental cleaner, a tongue cleaner or the like. Furthermore, combined oral hygiene products are conceivable, combining at least two different functions, for example a toothbrush with a tongue cleaner, a toothbrush with massaging elements, an interdental cleaner with a flossing implement or others of the like.

The oral hygiene product 10 has at least one application unit 12. Furthermore, the oral hygiene product 10 has at least one handle unit 14. The at least one handle unit 14 is formed partly from a soft component 16 and partly from a hard component 18.

Reference is made hereafter to FIGS. 1 to 14, which show different views of the oral hygiene product 10. On account of the different views, some elements are not depicted in all of the figures and are correspondingly not provided with designations in all of the figures. FIG. 2 shows a rear side 62 of the oral hygiene product 10 in a schematic perspective representation. FIG. 3 shows a side 64, in particular a left longitudinal side, of the oral hygiene product 10 in a schematic representation. FIG. 4 shows a front side 60 of the oral hygiene product 10 in a schematic representation. FIG. 5 shows a rear side 62 of the oral hygiene product 10 in a schematic representation. FIG. 6 shows an upper side 66 of the oral hygiene product 10 in a schematic representation. FIG. 7 shows an underside 68 of the oral hygiene product 10 in a schematic representation. FIG. 8 shows a further side 70, in particular a right longitudinal side, of the oral hygiene product 10 in a schematic representation with a depicted mold parting line 114. FIG. 9 shows a schematic sectional representation of the oral hygiene product 10 along the sectional line IX-IX in FIG. 4. FIG. 10 shows a schematic sectional representation of the oral hygiene product 10 along the sectional line X-X in FIG. 9. FIG. 11 shows a schematic sectional representation of the oral hygiene product 10 along the sectional line XI-XI in FIG. 4. FIG. 12 shows a schematic sectional representation of the oral hygiene product 10 along the sectional line XII-XII in FIG. 4. FIG. 13 shows a schematic sectional representation of the oral hygiene product 10 along the sectional line XIII-XIII in FIG. 4. Finally, FIG. 14 shows a schematic sectional representation of the oral hygiene product 10 along the sectional line XIV-XIV in FIG. 5.

The oral hygiene product 10 has a longitudinal axis 72, a height axis 74 and a width axis 76 (cf. 7). The longitudinal axis 72 is arranged parallel to a main direction of extent of the oral hygiene product 10. If the oral hygiene product 10 has been placed with the rear side 62 onto a planar surface, so that the longitudinal axis 72 is arranged parallel to the surface, the height axis 74 is arranged perpendicularly to the longitudinal axis 72 and perpendicularly to the surface and to the width axis 76. The width axis 76 is arranged perpendicularly to the longitudinal axis 72 and perpendicularly to the height axis 74. In the present case, the oral hygiene product 10 has a length, in particular parallel to the longitudinal axis 72, of 140 mm to 210 mm and preferably of 165 mm to 185 mm. Furthermore, the oral hygiene product 10 has a height, in particular parallel to the height axis 74, of 12 mm to 25 mm and preferably 15 mm to 19 mm. Moreover, the oral hygiene product 10 has a width, in particular parallel to the width axis 76, of 10 mm to 20 mm and preferably of 12 mm to 17 mm.

The at least one application unit 12 has a brush head 20. In the present case, the brush head 20 is formed as a toothbrush head. The brush head 20 has in particular a bristle carrier. The brush head 20 is formed partly from a soft component 16 and partly from a hard component 18. The brush head 20 has a width, in particular parallel to the width axis 76, of 8 mm to 17 mm and preferably 10 mm to 15 mm. The brush head 20 comprises at least one cleaning region, which comprises a plurality of tufts of bristles. For reasons of overall clarity, the tufts of bristles are not depicted in FIGS. 1 to 14. On the front side 60 of the brush head 20, at least one circular hollow 78 is formed. The at least one hollow 78 is intended for receiving a tuft of bristles. In principle, the at least one hollow 78 may also be differently designed. Corning into consideration as bristles are any suitable bristles which, as described above, can be fitted by punching, for example by the anchor punching method. The construction of the brush head 20, or at least the front side 60 of the brush head 20, is different in other bristle-providing methods. Tufts of bristles may differ with regard to their length, their composition, their number of bristles, a bristle material, a color, a surface structuring and other aspects of the like. Similarly, angles at which the bristles and/or the tufts of bristles are arranged in relation to one another or in relation to a surface of the brush head 20 may vary between bristles and/or between tufts of bristles. Furthermore, the application unit 12 comprises in the present case at least one neck element 80, which in particular connects the brush head 20 to the handle unit 14.

The application unit 12 is arranged on the upper side 66 of the oral hygiene product 10. The application unit 12 forms an uppermost point of the oral hygiene product 10. The application unit 12 is formed partly from a soft component 16 and partly from a hard component 18. With respect to suitable soft and hard components 16, 18, reference is made to the foregoing description. In the present case, the hard component 18 is for example a polypropylene (PP). Moreover, in the present case, the soft component 16 is for example a thermoplastic elastomer. In particular, the brush head 20 and/or the neck element 80 is formed partly from the soft component 16 and substantially from the hard component 18. The brush head 20 is formed on the front side 60 at least substantially from a hard component 18.

In principle, the application unit 12 may have at least one tongue cleaner element. The tongue cleaner element may have nubs and/or lamellae. Preferably, the tongue cleaner element is arranged on the rear side 62 of the brush head 20; in particular, it may be arranged on a ring of a soft component 16 and/or on an island of a hard component 18.

The neck element 80 forms a transition between the application unit 12 and the handle unit 14. The neck element 80 is formed partly from the hard component 18 and partly from the soft component 16. The lower end of the neck element 80 is partly formed all-around from the soft component 16. The lower end of the neck element 80 is at least partly formed as resilient.

The soft component 16 extends at least over a substantial part of a main extent of the at least one handle unit 14. The soft component 16 extends continuously over a large portion of a main extent of the oral hygiene product 10. The soft component 16 forms at least 30%, preferably at least 40% and with particular preference at least 50%, of an outer surface of the at least one handle unit 14. From the neck element 80 to the brush head 20, the soft component 16 respectively forms a strand 82, 84 laterally on a left longitudinal side and a right longitudinal side of the oral hygiene product 10. On the rear side 62 of the oral hygiene product 10, the soft component 16 forms a ring-like structure 86, which surrounds the brush head 20 and the neck element 80 and is uninterrupted. Seen from the rear side 62, an island 88 of the hard component 18 forms on the surface of the neck element 80 and of the brush head 20. Seen from the rear side 62, the island 88 of the hard component 18 forms on the neck element 80 a linear shape along the longitudinal axis 72, which in the region of the brush head 20 goes over into a roundish shape. The edge region of the brush head 20 is framed on the rear side 62 in particular by the soft component 16. The strand 82, 84 made of the soft component 16 has a height, in particular parallel to the height axis 74, which is greater than its width, in particular parallel to the width axis 76.

The at least one handle unit 14 has at least one thumb gripping region 22 with a gripping surface 24 of the hard component 18 and at least one structure element 26, 28 made of the soft component 16 and rising above the gripping surface 24. The at least one structure element 26, 28 is completely encompassed by the gripping surface 24. The gripping surface 24 runs on the front side 60 from the thumb gripping region 22 to the lower end of the oral hygiene product 10 on the underside 68. The gripping surface 24 forms along the longitudinal axis 72 a dished or concave shape. The gripping surface 24 forms in the thumb gripping region 22 along the longitudinal axis 72 a dip 90. This design of the oral hygiene product 10 allows an advantageously adapted thumb shape to be achieved. The dished shape is formed inversely along the longitudinal axis 72 in the direction of the underside 68. In a middle region of the gripping surface 24, in particular lettering could be arranged. The lettering may be provided on the oral hygiene product 10 in particular by embossing. Preferably, the soft component 16 forms lettering in the hard component 18, in particular by penetrating from the rear side 62. Advantageously, the surface in this case remains planar. The thumb gripping region 22 is arranged on the front side 60 of the oral hygiene product 10. The thumb gripping region 22 comprises a plurality of structure elements 26, 28, only some of which are provided with designations for reasons of overall clarity. In the present case, the thumb gripping region 22 has six structure elements arranged in a row along the longitudinal axis 72. The at least one structure element 26, 28 is formed from a soft component 16. The at least one structure element 26, 28 is in particular connected in one piece to the soft component 16. The at least one structure element 26, 28 is in the present case formed as a material elevation rising above the gripping surface 24 and has in particular a sickle-shaped cross section, any other geometries, in particular straight or wavy lines, being conceivable. Depressions are similarly conceivable. Furthermore, a size of the structure elements changes along the longitudinal axis 72, centrally arranged structure elements being larger than those arranged at the edges. Moreover, in particular half of the structure elements are aligned mirror-invertedly in relation to the other half of the structure elements along the longitudinal axis 72. In particular, the alignment of the structure elements changes in a central region of the thumb gripping region on the longitudinal axis 72. A radius of the sickle-shaped structure elements 26, 28 respectively points in the direction of the central region of the thumb gripping region. The structure elements 26, 28 arranged in a mirrored manner over the central region of the thumb gripping region are in each case formed similarly, but in particular not symmetrically formed. Each half of the structure elements 26, 28 has a number of structure elements, in particular of one to five structure elements 26, 28 and preferably of two to three structure elements 26, 28. The structure elements 26, 28 have in each case a width, in particular parallel to the width axis 76, of 3 mm to 12 mm and preferably of 5 mm to 9 mm. The structure elements 26, 28 have in each case a height, in particular parallel to the height axis 74, of 0.5 mm to 2 mm and preferably of 0.8 mm to 1.5 mm. The height of the structure elements 26, 28 varies on account of the dished gripping surface 24 over the individual structure element 26, 28. The structure elements 26, 28 have in each case at the outer ends of the structure element 26, 28, in particular in the direction of the width axis 76, a smaller height than in the middle of the structure element 26, 28. The at least one structure element 26, 28 has a length, in particular parallel to the longitudinal axis 72, of 0.3 mm to 3 mm and preferably of 0.5 mm to 2 mm. The at least one handle unit 14 has at least one delimiting wall 30 made of the soft component 16 and at least substantially delimiting the gripping surface 24. The at least one delimiting wall 30 rises above the at least one structure element 26, 28. The at least one delimiting wall 30 delimits the gripping surface 24 at least towards the application unit 12. The thumb gripping region 22 comprises the delimiting wall 30. The delimiting wall 30 runs in the direction of the underside 68. The delimiting wall 30 has a height at the upper end of the delimiting wall 30, in particular parallel to the height axis, of 0.5 mm to 3 mm and preferably of 1 mm to 2 mm. The delimiting wall 30 forms an offset in relation to the gripping surface 24. With respect to the direction of the height axis 74, in the direction of the front side 60, the delimiting wall 30 rises above the at least one structure element 26, 28.

The handle unit 14 has at least one additional gripping region 92 in a lower region of the handle unit 14. The additional gripping region 92 has at least one structure element 94. The at least one structure element 94 is formed from the soft component 16. The at least one structure element 94 is completely encompassed by the gripping surface 24. The at least one structure element 94 is arranged on the front side 60 of the oral hygiene product 10. The additional gripping region 92 has a plurality of structure elements 94, only some of which are provided with designations for reasons of overall clarity. In the present case, the additional gripping region 92 has three structure elements 94, arranged in a row along the longitudinal axis 72. The additional gripping region 92 has a number of structure elements, in particular from two to eight structure elements and preferably three to five structure elements. The at least one structure element 94 is formed at least substantially flush with the gripping surface 24 and has in particular a sickle-shaped cross section, any other geometries, in particular straight or wavy lines, being conceivable. Depressions are similarly conceivable. The gripping surface 24 is shaped in the additional gripping region in a dished form in the width direction. Furthermore, a size of the structure elements changes along the longitudinal axis 72 within the additional gripping region 92, centrally arranged structure elements being larger than those arranged at the edges. An inner radius of the at least one sickle-shaped structure element 94 points in the direction of the underside 68. The structure elements arranged in the additional gripping region 92 are in each case formed similarly but not identically. The at least one structure element 94 has a width, in particular parallel to the width axis 76, of 3 mm to 12 mm and preferably of 5 mm to 9 mm. The at least one structure element 94 has a length, in particular parallel to the longitudinal axis 72, of 0.3 mm to 3 mm and preferably of 0.5 mm to 2 mm. The at least one structure element 94 has at the outer ends of the structure element 94, in particular in the direction of the width axis 76, a smaller length than in the middle of the structure element 94.

The at least one handle unit 14 has at least one concavely curved essential gripping surface 32. The at least one concavely curved essential gripping surface 32 is at least largely formed from the soft component 16 and has at least two islands 34, 36 of the hard component 18. The at least one concavely curved essential gripping surface 32 is arranged on a rear side 62 of the handle unit 14 that is facing away from the thumb gripping region 22. The gripping surface 32 runs on the rear side 62 from the underside 68 as far as the neck element 80. The at least one concavely curved essential gripping surface 32 has an index finger gripping region 38 made of the soft component 16. Arranged in the index-finger gripping region 38 are the structure elements 40, 42 made of the soft component 16 and rising above the essential gripping surface 32. The gripping surface 32 forms in the index-finger gripping region 38 along the longitudinal axis 72 a dip 96. The dip 96 has a length, in particular parallel to the longitudinal axis 72, in particular of 20 mm to 60 mm and preferably of 30 mm to 45 mm. The dip 96 has a width, in particular parallel to the width axis 76, in particular of 5 mm to 15 mm and preferably of 7 mm to 12 mm. The dip 96 runs in a rounded form into the continuing geometries of the soft component 16, both in the direction of the longitudinal axis and in the direction of the width axis. The dip 96 itself has a rounded shape. The index-finger gripping region 38 has at least one structure element 40, 42 rising above the gripping surface 32. The at least one structure element 40, 42 is formed from a soft component 16. The at least one structure element 40, 42 is in particular connected in one piece with the soft component 16. The at least one structure element 40, 42 is arranged on the rear side 62 of the oral hygiene product 10. The at least one structure element 40, 42 forms an at least substantially planar transition over the dip 96 parallel to the width axis 76. The index-finger gripping region 38 has a plurality of structure elements 40, 42, only some of which are provided with designations for reasons of overall clarity. In the present case, the index-finger gripping region 38 has eight structure elements arranged in a row along the longitudinal axis 72. The index-finger gripping region 38 has a number of structure elements, in particular of two to fourteen structure elements and preferably of four to ten structure elements. The at least one structure element 40, 42 is in the present case formed as a material elevation that at least substantially rises above the gripping surface 32 and has in particular a sickle-shaped cross section, any other geometries, in particular straight or wavy lines, being conceivable. Depressions are similarly conceivable. Furthermore, a size of the structure elements changes along the longitudinal axis 72, centrally arranged structure elements being larger than those arranged at the edges. Moreover, in particular half of the structure elements are aligned mirror-invertedly in relation to the other half of the structure elements along the longitudinal axis 72. In particular, the alignment of the structure elements changes in a central region of the index-finger gripping region 38 on the longitudinal axis 72. A radius of the at least one sickle-shaped structure element 40, 42 points in the direction of the central region of the index-finger gripping region 38. The structure elements arranged in a mirrored manner over the central region of the index-finger gripping region 38 are in each case formed similarly, but in particular not symmetrically formed. The at least one structure element 40, 42 has a width, in particular parallel to the width axis 76, of 3 mm to 15 mm and preferably of 4 mm to 12 mm. The at least one structure element 40, 42 has a height, in particular parallel to the height axis 74, of 0.5 mm to 2 mm and preferably of 0.9 mm to 1.5 mm. The structure elements have in particular different heights. The height of the structure element varies on account of the sunken gripping surface 32 over the individual structure element. The structure elements 40, 42 have in each case at the outer ends of the structure element, in particular in the direction of the width axis, a smaller height than in the middle of the structure element, while the surface of the structure element can go over into the gripping surface 32 at the outer ends of the structure element. The height of the at least one structure element 40, 42 corresponds at least substantially to the depth of the dip 96. The at least one structure element 40, 42 has a length, in particular parallel to the longitudinal axis 72, of 0.5 mm to 2 mm and preferably of 1 mm to 1.7 mm. The at least one structure element 40, 42 preferably has a sickle-shaped cross section. The at least one structure element 40, 42 has at the outer ends of the structure element 40, 42, in particular on the left and right, a smaller length than in the middle of the structure element 40, 42.

Moreover, the handle unit 14 has at least one concavely curved essential gripping surface 32. The at least one concavely curved essential gripping surface 32 has a little-finger gripping region 44 made of the soft component 16. Arranged in the little-finger gripping region 44 are the structure elements 46, 48 made of the soft component 16 and rising above the essential gripping surface 32. The gripping surface 32 forms in the little-finger gripping region 44 along the longitudinal axis 72 a dip 98. The dip 98 is formed partly from the soft component 16 and partly from the hard component 18. The dip 98 is formed from the hard component 18 in particular in the region in the direction of the underside 68. The dip 98 is formed from the soft component 16 in particular in the little-finger gripping region 44. The dip 98 has a transition between the soft component 16 and the hard component 18, the transition forming an offset 100. The dip 98 runs in a rounded form into the continuing geometries of the soft component 16. The little-finger gripping region 44 has at least one structure element 46, 48 rising above the gripping surface 32. The at least one structure element 46, 48 is formed from a soft component 16. The at least one structure element 46, 48 is in particular connected in one piece with the soft component 16. The at least one structure element 46, 48 is arranged on the rear side 62 of the oral hygiene product 10. The at least one structure element 46, 48 forms an at least substantially planar transition over the dip 98 parallel to the width axis 76. The little-finger gripping region 44 has a plurality of structure elements 46, 48, only some of which are provided with designations for reasons of overall clarity. In the present case, the little-finger gripping region 44 has three structure elements arranged in a row along the longitudinal axis 72. The little-finger gripping region 44 has a number of structure elements, in particular of one to five structure elements and preferably of two to three structure elements. The at least one structure element 46, 48 is in the present case formed as a material elevation that at least substantially rises above the gripping surface 32 and has in particular a sickle-shaped cross section, any other geometries, in particular straight or wavy lines, being conceivable. Depressions are similarly conceivable. Furthermore, a size of the structure elements changes along the longitudinal axis 72, structure elements arranged in the direction of the underside 68 being larger than structure elements 46, 48 arranged in the direction of the upper side 66. A radius of the at least one sickle-shaped structure element 46, 48 points in the direction of the underside 68. The structure elements arranged in the little-finger gripping region 44 are in each case formed similarly, but in particular not symmetrically formed. The at least one structure element 46, 48 has a width, in particular parallel to the width axis 76, of 3 mm to 15 mm and preferably of 5 mm to 12 mm. The at least one structure element 46, 48 has a height, in particular parallel to the height axis 74, of 0.5 mm to 1.5 mm and preferably of 0.7 mm to 1.3 mm. The structure elements have in particular different heights. The height of the structure element varies on account of the sunken gripping surface 32 over the individual structure element. The at least one structure element 46, 48 has at the outer ends of the structure element 46, 48, in particular in the direction of the width axis 76, a smaller height than in the middle of the structure element 46, 48, while the surface of the structure element 46, 48 can go over into the gripping surface 32 at the outer ends of the structure element 46, 48. The height of the at least one structure element 46, 48 corresponds at least substantially to the depth of the dip 98. The at least one structure element 46, 48 has a length, in particular parallel to the longitudinal axis 72, of 0.5 mm to 2 mm and preferably of 1 mm to 1.7 mm. The at least one structure element 46, 48 preferably has a sickle-shaped cross section. The at least one structure element 46, 48 has at the outer ends of the structure element 46, 48, in particular in the direction of the width axis 76, a smaller length than in the middle of the structure element 46, 48.

Furthermore, the handle unit 14 has at least one middle- and ring-finger gripping region 102. The middle- and ring-finger gripping region 102 is in the present case arranged on the rear side 62 of the oral hygiene product 10. The middle- and ring-finger gripping region 102 comprises a plurality of structure elements, which are not all provided with designations for reasons of overall clarity. The at least one structure element 104 forms an island 34 of the hard component 18, the island 34 being completely surrounded by the soft component 16. The at least two islands 34, 36 are formed at least substantially flush with the gripping surface 32. The at least two islands 34, 36 preferably have, seen from the rear side 62, in each case a roundish and/or oval shape, any other geometries with a closed contour being conceivable. The middle- and ring-finger gripping region 102 has a number of structure elements, in particular of four to sixteen structure elements and preferably of six to twelve structure elements. The structure elements are arranged in relation to the longitudinal axis 72 symmetrically in two rows, in particular at a distance from the longitudinal axis 72 and on a slight, inwardly bent curve in relation to the longitudinal axis 72. In the middle- and ring-finger gripping region 102, the at least one structure element 104 is mirrored at the longitudinal axis 72 and forms a second symmetrical structure element 106, these two structure elements 104, 106 respectively forming two islands 34, 36. The at least two islands 34, 36 are arranged between the index-finger gripping region 38 and the little-finger gripping region 44. The structure elements arranged in the middle- and ring-finger gripping region 102 are in each case formed similarly but in particular are not formed identically. Furthermore, a size of the structure elements changes along the longitudinal axis 72, centrally arranged structure elements being larger than those arranged at the edges. The middle- and ring-finger gripping region 102 is substantially formed from the soft component 16, with the exception of the islands 34, 36, which are formed from the hard component 18. The middle- and ring-finger gripping region 102 also comprises an entire central portion of the oral hygiene product 10, which can for example be gripped around with a hand during use.

In particular, in a held state, a thumb comes to lie in the thumb gripping region 22, an index finger comes to lie in the index-finger gripping region 38, a middle finger and a ring finger come to lie in the middle- and ring-finger gripping region 102 and a little finger comes to lie on the little-finger gripping region 44. In principle, the oral hygiene product 10 may however also be used by a user with a different placement position of the fingers than that envisaged.

The at least one handle unit 14 has at an end facing away from the application unit 12 a planar resting area 58. The planar resting area 58 serves for the oral hygiene product 10 to be put down in a defined way. The oral hygiene product 10 has an imaginary resting plane. The imaginary resting plane extends free from points of intersection along at least two spaced-apart points/areas of the oral hygiene product 10. The planar resting area 58 extends parallel to a main plane of extent of the oral hygiene product 10 and defines an imaginary resting plane. The planar resting area 58 is formed in a crescent-shaped manner. The planar resting area 58 is formed from a hard component 18. The planar resting area 58 is arranged on the rear side 62 of the oral hygiene product 10. The planar resting area 58 is arranged on the underside 68 of the oral hygiene product 10. The planar resting area 58 forms in particular a lower end of the oral hygiene product 10 on the rear side 62 in the direction of the underside 68. The planar resting area 58 has a width, in particular parallel to the width axis 76, of 5 mm to 18 mm and preferably of 8 mm to 12 mm. The planar resting area 58 has a length, in particular parallel to the longitudinal axis 72, of 2 mm to 10 mm and preferably of 3 mm to 7 mm. The planar resting area 58 is intended for putting the oral hygiene product 10 down on an imaginary resting plane. The oral hygiene product 10 has a resting point 108, preferably a resting line and with particular preference a resting area. The resting point 108, in particular the one resting area, is formed from a hard component 18. The resting point 108, in particular the resting area, is arranged on the rear side 62 of the oral hygiene product 10. The resting point 108, in particular the resting area, is arranged in the region of the neck element 80. The resting area 58 and the resting point 108, in particular the resting area, form a mount for the oral hygiene product 10 on an imaginary resting plane. Advantageously, the resting area 58 is relatively wide, in order that the oral hygiene product 10 rests stably on an imaginary resting plane. A maximum distance between a rear side 62 of the handle unit 14 and the resting plane, measured perpendicularly to the resting plane, is at least 5 mm, preferably at least 7 mm and with particular preference at least 9 mm.

In a put-down position, the oral hygiene product 10 has a gap 110 between the handle unit 14 and the imaginary resting plane. The gap 110 has a height, in particular parallel to the height axis 74, of 3 mm to 18 mm and preferably of 7 mm to 13 mm. The handle unit 14 has in a region above the index-finger gripping region 38 on the rear side 62 a comparatively extreme bend. The resting point 108 and/or a resting line and/or a resting area and the resting area 58 are at a distance, in particular parallel to the longitudinal axis 72, of 110 mm to 160 mm and preferably of 125 mm to 140 mm.

The oral hygiene product 10 has a plurality of protuberances and indentations, which are distributed along its longitudinal axis 72. In the present case, the oral hygiene product 10 has, when looking at its front side 60, three protuberances and two constrictions. Preferably, transitions between protuberances and constrictions are rounded here, but straight transitions are also conceivable. Furthermore, the oral hygiene product 10, when looking at its side 64, 70, is formed as curved, whereby in particular resilient properties of the application unit 12 are advantageously obtained in a known way. A person skilled in the art will adapt a shaping of the oral hygiene product 10 in a way that is expedient and is appropriate for the application.

In the present case, all of the elements of the oral hygiene product 10 are produced from the soft component 16 in a common injection-molding step. The oral hygiene product 10 has at least one soft element made of the soft component 16, which forms at least part of the handle unit 14 and advantageously of the application unit 12. Preferably, the soft element forms all of the soft-component elements of the oral hygiene product 10. The soft element may also form the bristles and/or cleaning elements of the application unit 12.

The soft element extends on the underside 68 of the oral hygiene product 10 uninterruptedly from the handle unit 14, in particular the little-finger gripping region 44, over the neck element 80 as far as the application unit 12 (the upper side 66). The soft element has a single injection point 112. The injection point 112 of the soft element is arranged on the rear side 62 of the oral hygiene product 10. The injection point 112 is arranged on the longitudinal axis 72. The injection point 112 is arranged in a region underneath the middle- and ring-finger gripping region 102. The injection point 112 is arranged between the middle- and ring-finger gripping region 102 and the little-finger gripping region 44. The injection point 112 is at a distance from the free end on the underside 68, in particular parallel to the longitudinal axis 72, of 20 mm to 40 mm and preferably of 25 mm to 35 mm.

The production of the oral hygiene product 10 is performed by means of two negative molds. In this respect, the oral hygiene product 10 has a mold parting line 114. The mold parting line 114 runs over the entire length of the oral hygiene product 10 and is explicitly shown in FIGS. 8 and 16. A mold parting line 114 running over the soft component 16 differs in this case from a mold parting line 114 running over the hard component 18, where in particular the mold parting line 114 running over the hard component 18 is partly also used for demolding the soft component 16. The mold parting line 114 has a curved shape over the length of the oral hygiene product 10, while the curved shape at least substantially follows the shape of the oral hygiene product 10. The mold parting line 114 runs in the middle height region of the oral hygiene product 10. The mold parting line 114 runs along the widest location in the cross section of the oral hygiene product 10. Consequently, good demoldability in the injection-molding tool can be advantageously achieved. The negative molds can consequently be advantageously removed from the oral hygiene product 10 without an undercut having to be overcome.

The at least one handle unit 14 has at least one lateral streak 50, 52 of the hard component 18. The at least one lateral streak 50, 52 is completely delimited by the soft component 16. The at least one lateral streak 50, 52 is formed on a left longitudinal side and on a right longitudinal side of the oral hygiene product 10 and is preferably bent in a way that corresponds to the shape of the handle. The at least one lateral streak 50, 52 is formed from the hard component 18. The at least one lateral streak 50, 52 has a length, in particular parallel to the longitudinal axis 72, in particular of 35 mm to 80 mm and preferably of 45 mm to 65 mm. The at least one lateral streak 50, 52 has a height, in particular parallel to the height axis 74, in particular of 1 mm to 5 mm and preferably of 1.5 mm to 3.5 mm. The lateral streak 50, 52 advantageously forms a supporting geometry for an injection-molding process of the soft component 16. The mold parting line 114 runs at least partly in the middle of the lateral streak 50, 52, the mold parting line 114 leaving the lateral streak 50, 52 in the lower region in the direction of the front side 60.

The at least one handle unit 14 has at least one tongue 54, 56 made of the soft component 16. The at least one tongue 54, 56 extends over the lateral streak 50, 52. The neck element 80 forms at least one decorative element 116. The neck element 80 forms in the present case three decorative elements 116. The at least one decorative element 116 is formed partly from a soft component 16 and partly from a hard component 18. The at least one decorative element 116 is arranged at the lower end of the neck element 80. The hard component 18 of the at least one decorative element 116 forms a ring-shaped, in particular oval, structure. The at least one decorative element 116 may be at least partially supplied with the soft component 16 from the rear side 62. The at least one decorative element 116 is supplied with the soft component 16 from the rear side 62 during the production of the oral hygiene product 10. The at least one decorative element 116 advantageously serves for supporting the main body 120 in an injection-molding process of the soft component 16. The soft component 16 of the at least one decorative element 116 surrounds the ring-shaped structure of the hard component 18. The decorative element 116 forms in its middle an island 118 of the soft component 16. The at least one decorative element 116 is completely surrounded by the soft component 16. The soft component 16, which surrounds the at least one decorative element 116, respectively forms in the direction of the left longitudinal side and the right longitudinal side the tongue 54, 56. The tongue 54, 56 is formed from the soft component 16. The tongue 54, 56 protrudes out of the hard component 18 into the laterally arranged streak 50, 52. The tongue 54, 56 protrudes in particular beyond the mold parting line 114.

The oral hygiene product 10 has at least one, in particular precisely one, main body 120 of the hard component 18, which forms at least part of the handle unit 14 and of the application unit 12. In the present case, the main body 120 forms all of the hard components 18 of the oral hygiene product 10.

Reference is made hereafter to FIGS. 15 to 18, which show different representations of the main body 120. On account of the different views, some elements are not depicted in all of the figures and are correspondingly not provided with designations in all of the figures. Moreover, for reasons of overall clarity, not all of the designations introduced in FIGS. 1 to 14 are shown. With corresponding reference, attention is drawn to these particular figures. FIG. 15 shows a front side 60 of a main body 120 of the oral hygiene product 10 in a schematic representation. FIG. 16 shows a side 70, in particular a right longitudinal side, of the main body 120 of the oral hygiene product 10 in a schematic representation. FIG. 17 shows a rear side 62 of the main body 120 of the oral hygiene product 10 in a schematic representation. FIG. 18 shows a schematic sectional representation of the main body 120 of the oral hygiene product 10 along the sectional line XVIII-XVIII in FIG. 15.

In the production of the oral hygiene product 10, in a first production step the main body 120 is produced in an injection-molding process. In a second production step, the main body 120 is encapsulated with at least one further component, in particular a soft component 16.

The main body 120 has at least one aperture. A first aperture 122 is arranged in the decorative element 116. The first aperture 122 has in the direction of the height axis 74 a shape in the form of an hourglass. This makes advantageous demolding of the main body 120 possible. A second aperture 124 and a third aperture 126 are arranged in the handle unit 14. The second aperture 124 is in this case arranged in particular between the thumb gripping region 22 and the index-finger gripping region 38. The third aperture 126 is arranged between the additional gripping region 92 and the little-finger gripping region 44. In the case of an implementation of lettering, at least one further aperture may also be arranged between the gripping surface 24 and the middle- and ring-finger gripping region 102. Apart from the apertures, during the injection-molding process use is advantageously made of further components, for example soft components, flowing around the main body 120, in particular in the region of the neck element 80. In the production of the oral hygiene product 10, the soft component 16 passes from its injection point 112 at least through one aperture from the rear side 62 to the front side 60 of the main body 120. In the region of the handle unit 14, the main body 120 is coated on the rear side 62 at least substantially completely with the soft component 16, with the exception of the islands 34, 36 in the middle- and ring-finger gripping region 102 and the resting area 58. The soft component 16 has a minimum thickness over the hard component 18 in particular of 0.1 mm to 2 mm and preferably of 0.2 mm to 1 mm. The main body 120 also has at least one channel 128, which is arranged in a region of the middle- and ring-finger gripping region 102 of the handle unit 14. The channel 128 extends along the longitudinal axis 72. The channel 128 may be formed with at least one aperture, the aperture being intended in particular for supplying lettering with a soft component 16. This aperture is not shown however in the present figures.

The main body 120 has a single injection point 130. The injection point 130 of the main body 120 is arranged on the rear side 62. The injection point 130 is arranged on the longitudinal axis 72. The injection point 130 is at a distance from the free end on the underside 68, in particular parallel to the longitudinal axis 72, of 8 mm to 28 mm and preferably of 13 mm to 22 mm. In a completed state of the oral hygiene product 10, the injection point 130 of the main body 120 is overmolded with the soft component 16. The injection point 130 of the main body 120 is arranged in a region of the injection point 112 of the soft element and is less than 20 mm, preferably less than 15 mm, away from it.

LIST OF DESIGNATIONS

10 Oral hygiene product
12 Application unit
14 Handle unit
16 Soft component
18 Hard component
20 Brush head
22 Thumb gripping region
24 Gripping surface
26 Structure element
28 Structure element
30 Delimiting wall
32 Gripping surface
34 Island
36 Island
38 Index-finger gripping region
40 Structure element
42 Structure element
44 Little-finger gripping region
46 Structure element
48 Structure element
50 Streak
52 Streak
54 Tongue
56 Tongue
58 Resting area
60 Front side
62 Rear side
64 Side
66 Upper side
68 Underside
70 Side
72 Longitudinal axis
74 Height axis
76 Width axis
78 Hollow
80 Neck element
82 Strand
84 Strand
86 Structure
88 Island
90 Dip
92 Additional gripping region
94 Structure element
96 Dip
98 Dip
100 Offset
102 Middle- and ring-finger gripping region
104 Structure element
106 Structure element
108 Resting point
110 Gap
112 Injection point
114 Mold parting line
116 Decorative element
118 Island
120 Main body
122 Aperture
124 Aperture
126 Aperture
128 Channel
130 Injection point

The invention claimed is:

1. An oral hygiene product comprising at least one application unit and at least one handle unit, the at least one handle unit being formed partly from a soft component and partly from a hard component, wherein the soft component extends at least over a substantial part of a main extent of the at least one handle unit, the at least one handle unit has at least one thumb gripping region with a gripping surface of the hard component and a plurality of structure elements made of the soft component and rising above the gripping surface, the plurality of structure elements of the at least one thumb gripping region are completely and separately encompassed by the gripping surface of the hard component, the application unit comprises at least one neck element, which connects a brush head to the handle unit, the thumb gripping region is on a front side of the oral hygiene product on a side of the gripping surface toward the neck element, the gripping surface is on the front side continuously from the thumb gripping region to an underside of the oral hygiene product, which is a tip of the oral hygiene product opposite an upper side, the plurality of structure elements of the thumb gripping region are, measured from a geometric center point, positioned closer to a geometric center of a bristle carrier of the brush head than the underside of the oral hygiene product, the at least one handle unit has at least one lateral streak of the hard component, which is completely delimited by the soft component, and the at least one handle unit has at least one tongue made of the soft component, which extends over the lateral streak.

2. The oral hygiene product as claimed in claim 1, wherein the brush head is formed partly from a soft component and partly from a hard component.

3. The oral hygiene product as claimed in claim 1, wherein the soft component extends continuously over a large portion of a main extent of the oral hygiene product.

4. The oral hygiene product as claimed in claim 1, wherein the at least one handle unit has at least one delimiting wall made of the soft component and at least substantially delimiting the gripping surface.

5. The oral hygiene product as claimed in claim 4, wherein the at least one delimiting wall rises above the plurality of structure elements of the at least one thumb gripping region.

6. The oral hygiene product as claimed in claim 4, wherein the at least one delimiting wall delimits the gripping surface of the at least one thumb gripping region at least towards the application unit.

7. The oral hygiene product as claimed in claim 1, wherein the at least one handle unit has at least one concavely curved gripping surface, which is at least largely formed from the soft component and has at least two islands of the hard component.

8. The oral hygiene product as claimed in claim 7, wherein the at least one concavely curved gripping surface is arranged on a rear side of the handle unit facing away from the thumb gripping region.

9. The oral hygiene product as claimed in claim 7, wherein the at least one concavely curved gripping surface has an index-finger gripping region made of the soft component, in which second structure elements made of the soft component rise above the at least one concavely curved gripping surface.

10. The oral hygiene product as claimed in claim 7, wherein the at least one concavely curved gripping surface has a little-finger gripping region made of the soft component, in which second structure elements made of the soft component rise above the at least one concavely curved gripping surface.

11. The oral hygiene product as claimed in claim 9, wherein the at least one concavely curved gripping surface has a little-finger gripping region made of the soft component, in which third structure elements made of the soft component rise above the at least one concavely curved gripping surface, and the at least two islands are between the index-finger gripping region and the little-finger gripping region.

12. The oral hygiene product as claimed in claim 1, wherein the at least one handle unit has at an end facing away from the application unit a planar resting area which serves for the oral hygiene product to be put down in a defined way.

13. The oral hygiene product as claimed in claim 1, comprising an imaginary resting plane, which extends free from points of intersection along at least two spaced-apart points of the oral hygiene product.

14. The oral hygiene product as claimed in claim 12, wherein the planar resting area extends parallel to a main plane of extent of the oral hygiene product and defines an imaginary resting plane.

15. The oral hygiene product as claimed in claim 12, wherein a maximum distance between a rear side of the handle unit and a resting plane of the planar resting area, measured perpendicularly to the resting plane, is at least 3 mm.

16. The oral hygiene product as claimed in claim 1, wherein each of the plurality of structure elements has a height perpendicular to a surrounding surface of the thumb gripping region of at least 0.5 mm.

17. The oral hygiene product as claimed in claim 1, wherein each of the plurality of structure elements has a width perpendicular to a longitudinal axis of the oral hygiene product between a left side and a right side, of at least 3 mm, and a length parallel to the longitudinal axis of the oral hygiene product of at least 0.5 mm.

18. An oral hygiene product comprising at least one application unit and at least one handle unit, the at least one handle unit being formed partly from a soft component and partly from a hard component, wherein the soft component extends at least over a substantial part of a main extent of the at least one handle unit, the at least one handle unit has at least one thumb gripping region with a gripping surface of the hard component and a plurality of structure elements made of the soft component and rising above the gripping surface, the plurality of structure elements each extend through a recess in the thumb gripping region of the hard component, the application unit comprises at least one neck element, which connects a brush head to the handle unit, the thumb gripping region is on a front side of the oral hygiene product on a side of the gripping surface toward the neck element, the gripping surface is on the front side continuously from the thumb gripping region to an underside of the oral hygiene product, which is a tip of the oral hygiene product opposite an upper side, the plurality of structure elements of the thumb gripping region are, measured from a geometric center point, positioned closer to a geometric center of a bristle carrier of the brush head than the underside of the oral hygiene product, the at least one handle unit has at least one lateral streak of the hard component, which is completely delimited by the soft component, and the at least one handle unit has at least one tongue made of the soft component, which extends over the lateral streak, the at least one handle unit has at least one delimiting wall made of the soft component and at least substantially delimiting the gripping surface, the at least one delimiting wall rises above the plurality of structure elements of the at least one thumb gripping region, and the delimiting wall delimits a gripping surface of the thumb gripping region in at least three directions, wherein the delimiting wall reaches around the gripping surface of the thumb gripping region in a C-shaped form.

* * * * *